US007124692B2

(12) United States Patent
Guenther et al.

(10) Patent No.: US 7,124,692 B2
(45) Date of Patent: Oct. 24, 2006

(54) OVERHEAD SUSPENDED TRANSPORTATION SYSTEM AND METHOD

(75) Inventors: Karl Guenther, Palm Harbor, FL (US); Wilfred Sergeant, Largo, FL (US)

(73) Assignee: Sky Train Corporation, Palm Harbor, FL (US)

( * ) Notice: Subject to any disclaimer, the term of this patent is extended or adjusted under 35 U.S.C. 154(b) by 0 days.

(21) Appl. No.: 10/685,300

(22) Filed: Oct. 14, 2003

(65) Prior Publication Data

US 2004/0134373 A1 Jul. 15, 2004

Related U.S. Application Data

(60) Provisional application No. 60/418,872, filed on Oct. 15, 2002.

(51) Int. Cl.
*B61B 3/00* (2006.01)

(52) U.S. Cl. ..... 105/148; 104/89

(58) Field of Classification Search ..... 104/89, 104/91, 93, 118; 105/141, 146, 147, 148, 105/150

See application file for complete search history.

(56) References Cited

U.S. PATENT DOCUMENTS 468,110 A * 2/1892 Hunt ..... 238/15
1,798,852 A 3/1931 Roghmanns
3,225,228 A 12/1965 Roshala
3,444,823 A 5/1969 Akmentin
3,534,689 A 10/1970 Barthalon
3,559,583 A 2/1971 Chadenson
3,580,181 A 5/1971 Bertin et al.
3,675,582 A 7/1972 Girard et al.
3,690,266 A 9/1972 Mayo
3,724,391 A 4/1973 Velde
3,799,061 A 3/1974 Bertin
3,861,315 A * 1/1975 Rypinski ..... 104/18
3,915,093 A 10/1975 Barthalon et al.
4,102,272 A 7/1978 Lehl et al.
4,171,670 A 10/1979 Roberts
4,175,637 A 11/1979 Bertelsen
4,265,181 A 5/1981 Schreyer et al.
4,314,512 A 2/1982 Gerhard et al.
4,703,697 A 11/1987 Bell
4,841,871 A * 6/1989 Leibowitz ..... 104/23.1
5,231,932 A 8/1993 Enderlein et al.
5,381,737 A * 1/1995 Trenary ..... 105/34.1
5,535,963 A 7/1996 Lehl et al.
5,590,603 A 1/1997 Lund
5,590,604 A 1/1997 Lund
5,738,016 A 4/1998 Scott
6,178,892 B1 1/2001 Harding (Continued)

FOREIGN PATENT DOCUMENTS

DE 3315862 10/1984

(Continued)

*Primary Examiner*—S. Joseph Morano
*Assistant Examiner*—Robert J. McCarry, Jr.
(74) *Attorney, Agent, or Firm*—Allen, Dyer, Doppelt, Milbrath & Gilchrist, P.A.

(57) ABSTRACT

An overhead transportation system includes a support structure positioning a running surface above ground level for operating a truck along the running surface. A car body is suspended from a beam or chassis carried by the truck in such a manner to place a center of rotation of the car body above the chassis and truck. Improved performance on curves is provided through superelevation of the tracks upon which fixed steel wheel assemblies of the truck ride.

63 Claims, 16 Drawing Sheets

U.S. PATENT DOCUMENTS

| | | | | |
|---|---|---|---|---|
| 6,202,566 | B1 | 3/2001 | Hutchinson | |
| 6,622,637 | B1 * | 9/2003 | Cummins | 105/199.2 |
| 2003/0047106 | A1 | 3/2003 | Rajaram | |

FOREIGN PATENT DOCUMENTS

| | | |
|---|---|---|
| DE | 9203605 | 10/1992 |

* cited by examiner

OVERHEAD SUSPENDED TRANSPORTATION SYSTEM AND METHOD

CROSS REFERENCE TO RELATED APPLICATION

This application incorporates by reference and claims priority to commonly owned Provisional Application Ser. No. 60/418,872 for "Vehicle Overhead Suspension System And Method Having Enhanced Performance On Curves" having a filing date of Oct. 15, 2002.

FIELD OF THE INVENTION

The invention generally relates to transport systems, and more particularly to high-speed mass transit, passenger and freight transportation systems that are suspended overhead above ground level.

BACKGROUND OF THE INVENTION

Overhead-suspended systems are known in the art and currently in operation. Typically, car bodies are suspended directly from and below trucks. In one case the trucks have steel wheels running on top of a single steel rail, being truly a "Monorail". This allows the car bodies to swing out in curves but imposes limits on speed because of the suspension system. In another case, the trucks run inside a duct on rubber tires with side wheels to guide the non-steering rubber wheels with the car bodies suspended directly from the trucks. The roof of each car body typically serves as a rigid frame to which the trucks are attached. This fixes the distance between the trucks. The propulsion and braking forces generated in the trucks are limited as a result of the force being transmitted directly down to the car bodies through their suspension attachments.

In such cases the direct suspension of the bodies from the trucks results in difficulties when detaching or exchanging the car bodies. It also imposes limitations on the ability to couple vehicles into trains because such coupling is done at the car bodies and not at the trucks where the traction forces are generated.

As will be described for embodiments of the present invention, an Overhead-Suspended Light Rail (OSLR) system overcomes known limitations in typical overhead transport systems. The disadvantages that embodiments of the OSLR of the present invention can overcome include, but are not limited to the following herein presented, by way of example:

Light Rail Transit (LRT) uses tracks at grade level occupying land that is typically sterilized against other uses. In many places, the work of installing these tracks requires purchase of property, displacement of occupants, and disruption of commercial operations. In streets, it disrupts traffic movements for long periods of time. Especially costly is the needed utilities relocation. Cities that did not plan for a transit trench now require that whole drainage systems, natural gas, water service, telephone, cable TV and power be relocated. In mature cities the location of these is not accurately defined, thus creating expensive and hazardous conditions for workers. Embodiments of the OSLR of the present invention incorporates LRT technology but places tracks and train operations overhead, allowing existing land uses to continue without conflict and minimizes traffic interruption during construction. This avoids a need for new laboratory research, requiring that the system be engineered and installed only in an appropriate location.

LRT tracks and switches at grade are sensitive to climatic conditions such as snow, freezing rain and flooding from heavy rainstorms. The OSLR places the tracks, signals and power contact strips inside a covered duct with full protection from the weather.

LRT vehicles operating in the streets absorb traffic capacity from roadways already congested with other traffic. The vehicles become equally delayed because they cannot move any faster than this same congestion. They introduce risks of collisions, injuries and deaths with vehicles and pedestrians, and impose limits of permissible operating speeds. These risks of moving trains in the streets require that such vehicles be manually operated, preventing any prospect of full automation, with its associated economic and safe operation. There are strict limits on the lengths and speeds of trains in the streets, and on the frequency of trains, making it difficult to expand capacity to meet future growth. The OSLR herein described operates trains safely overhead and well separated from other operations and land uses on the ground, thus allowing full automation with train lengths and operating speeds free from speed restrictions typically placed at ground level.

Passengers and freight riding in LRT vehicles mounted above their wheels (bottom-supported) typically feel the shocks and lateral accelerations generated below them. Typical vehicle designs attempt to minimize this effect, but do not eliminate it. Passengers and freight in embodiments of the OSLR vehicles of the present invention ride below the wheels. Suspending the car body beneath a carrying vehicle effectively suspends the body like a pendulum, isolating it from lateral impacts sustained by the carrying vehicle and therefore affording a much smoother ride for passengers and freight.

Bottom-supported vehicles impose strict limitations on an amount of super-elevation to be tolerated on curves, directly impacting permissible speeds of vehicles traversing curves. The OSLR vehicles of the present invention avoid known constraints. As a result, greater super-elevation may be placed on curves, and the swing out of the car bodies enhances the effect to double the effective super-elevation allowing significantly faster operating speeds on the curves.

Further, there is a need for shorter journey times, for reducing the size of vehicle fleet required to fill any given operating schedule, for improving the productivity of the train equipment, and for marketing a quality of service superior to alternative systems and more attractive to the public.

SUMMARY OF THE INVENTION

A transportation system according to the teachings of the present invention may include a support structure positioning a running surface above ground level for operating a truck along the running surface. A car body is suspended from a beam or chassis carried by the truck in such a manner to place a center of rotation of the car body at or well above the roof of the car. (Note: see 00018)

One embodiment of the present invention, an overhead-suspended light rail (OSLR) system is herein described using the technology of modern heavy-rail and light-rail systems while overcoming disadvantages known with tracks and transit operations installed at grade, typically in the streets and private rights of way. Embodiments of the present invention may include a duct system wherein an OSLR system places one or more carrying vehicles coupled as a train inside a duct above, with or without car bodies suspended beneath them.

In one embodiment including an "I" beam system, the OSLR system places one or more carrying vehicles coupled in a train riding on and below an arrangement of one "I" beam or a multiplicity of "I" beams above, with or without the car bodies suspended beneath them A suspended car body swings out on curves, allowing faster speeds while the contents inside the car body feel minimal lateral forces. Damping may be incorporated to suppress continuing oscillation. Such an embodiment may be applied by way of example, to intercity passenger service, to urban transit or to freight vehicles. The ability to go around curves faster reduces journey times, minimizes fleet requirements, improves comfort and provides a new image for mechanized transportation. Complete grade separation is achieved and overcomes the handicaps of laying rail tracks at grade, weeds and weed-killers, fences severing farms and communities, disruption of commerce and existing land uses, dangers at grade crossings, highway vehicles being hit by high speed trains, risks to children, trespassers and animals on the tracks, and the hazards of winter conditions, floods, snow removal and icing conditions.

A car body that is overhead and suspended simply swings back to the vertical position when brought to a standstill on a curve. Passengers feel no discomfort at standstill. Thus, passenger comfort does not govern the permissible super-elevation of the track or roadway above. The permissible super-elevation is governed by the limit of friction between the wheels and the running surface, so that, the wheels do not slide down towards the low side at standstill. Controlling factors limiting achievable superelevations on curves are applied to the combination of a carrying vehicle in the duct with a car body suspended beneath from those controlling bottom-supported vehicles. There are unexpected results using superelevation in suspended car bodies resulting from the teachings of the present invention.

By way of example, for a steel wheel embodiment, a 10° angle may be appropriate. Tests have been conducted that show angles before slip occurs exceeding 16 degrees, indicating 10° of super-elevation uses only 62% of this range. Suspending the car body beneath the carrying vehicle effectively suspends the body like a pendulum, isolating it from lateral impacts and suspension harmonics sustained by the carrying vehicle and therefore affords a much smoother ride for passengers and freight. Such a suspension allows the car body to be suspended with a center of rotation well above the roof of the car so that it is free to swing out on curves. The passengers do not sense lateral centrifugal forces, allowing speeds on curves to be faster than permitted in bottom-supported vehicles.

Placing the carrying vehicle in a closed duct I-beam or multiple I-beams allows use of standardized vehicle components using either light-rail or heavy-rail technology or other vehicle technology such as rubber tires or magnetic levitation (Maglev) able to move along the running surfaces of the duct. The duct or beam may serve as a continuous bridge or viaduct designed to carry the weight of trains of vehicles moving within and suspended below it. The carrying vehicles may be coupled together in trains in the duct, whether or not they have car bodies attached beneath, thus avoiding limitations to train lengths found in known overhead systems. Vehicles may be self-powered or may be without power to be hauled by other self-powered vehicles.

Carrying vehicles may use a truck at each end of the carrying vehicle using two trucks per vehicle or use single trucks carrying the ends of the adjacent carrying vehicles in an arrangement defined as "articulation". This articulation allows two vehicles to share the articulating truck, resulting in a reduction in the total number of wheels required to carry the train.

A closed duct protects the carrying vehicles and the installations therein against climatic conditions, providing a transportation service that continues without interruption from bad climatic conditions such as windstorms, snow and ice storms. Materials for this design may be of many forms with or without channels, pipes or conduits for the placement and transportation of various control or utilities such as fiber optics or street lighting.

Overhead suspension allow vehicles with suspended car bodies to move overhead and separated from all other functions, allowing the service to be completely automated for safety, reliability and economic operation. If there are segments of a route where the duct may descend low enough for the suspended bodies to travel closer to, the ground when entering a low station platform, a tunnel or subway segment, by way of example. In such a situation the operation ceases to be overhead and fully separated. It is then desirable to have a right of way in such segments of route for an automated operation adequately protected against trespass.

Embodiments of the present invention illustrated herein by way of example, show that it is a simple matter where applicable to incorporate a system of quick detach into the suspension system so that car bodies may be exchanged according to the needs of various commodities, either passengers or freight. The "Quick Detach" may carry the full weight of the suspended body once it is in place.

The chassis of the carrying vehicle may be provided with a winch and cable system or other lifting devices such as pneumatic cylinders so that the carrying vehicle may raise or lower the car body without external assistance, facilitating exchange and interchange of bodies, or allowing movement in service of the carrying vehicle without a car body attached beneath it. Such lifting devices do not need to continue carrying the weight of the suspended bodies once the quick detach is locked into place, relieving the weight from the lifting device, but may continue to serve as secondary safety devices in the event of any mechanical complications.

Embodiments of the quick detach may incorporate guides to ensure correct nesting of the components, so that car bodies with the compatible attachments above can be lifted either by lifting mechanisms incorporated in the chassis or by any contemporary means such as forklift trucks and offered up to the matching attachments on the chassis above and locked into place for safe transportation. Such allows for an accurate mating of electrical connections (if required) between the carrying vehicle and the suspended car or freight vehicle for heating or air conditioning, refrigeration of the container or freight car, door activation, lighting and communications. This nesting function ensures proper mating of the attachments on the body with the attachments on the carrying vehicles when bodies are lifted up to the carrying vehicles. The design quick detach system permits the operation of attaching and locking or unlocking and detaching the car bodies and remote controlling or automation.

The suspension system of the carrying vehicle adequately limits or prevents the longitudinal freedom of the suspended car body so that suspended car bodies can travel close together without impacting and thus allow safe passageways connecting body to body according to the needs for various commodities for either passengers or freight. Such embodiments limit the longitudinal freedom of the suspended car bodies beneath the carrying vehicle that allows the bodies to travel closely together without impacting each other.

Alternatively, the tracks within the duct or on the "I" beams may be of different carrying surfaces as desired, including steel wheels, roadway wheels, air cushions, magnetic elevating components or other means of movement on which vehicles and suspended bodies may move along the running surfaces of the duct.

An alternate embodiment of the present invention includes tracks attached on ledges on outer walls of the duct.

BRIEF DESCRIPTION OF THE DRAWINGS

Embodiment of the present invention are herein described by way of example with reference to the accompanying drawings in which.

DETAILED DESCRIPTION OF THE PREFERRED EMBODIMENTS

The present invention will now be described more fully with reference to the accompanying drawings in which preferred embodiments of the invention are shown and described. It is to be understood that the invention may be embodied in many different forms and should not be construed as limited to the illustrated embodiments set forth herein. Rather, these embodiments are provided so that this disclosure may be thorough and complete, and will convey the scope of the invention to those skilled in the art.

Figure 1:
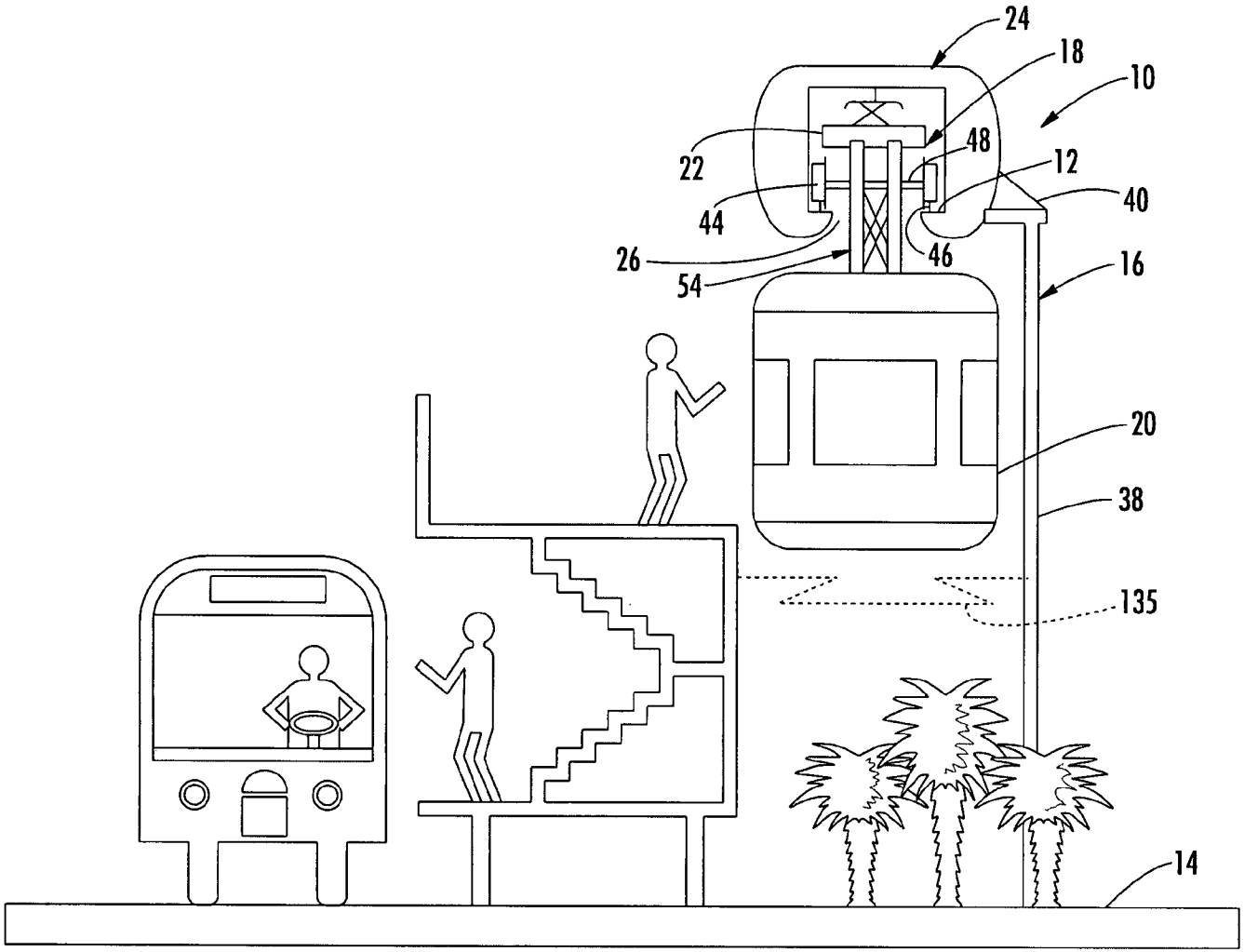
FIG. 1 is a pictorial elevation view of one embodiment of an overhead transportation system in keeping with the teachings of the present invention.

With reference initially to FIG. 1, a transportation system 10 following the teachings of the present invention may include a running surface 12 suspended above ground level 14 by a support structure 16. A truck 18, also known as a bogie, is operable along the running surface 12. As herein described by way of example, a car body 20 may be suspended from a chassis 22 carried by the truck 18 for suspending the car body above the ground level 14. As will be further described within this disclosure, the car body 20 will rotate laterally about a center of rotation that is above the roof of the car in this case at 22 that results in a desirable effect on passengers or cargo carried in the car body. It is to be understood that the car body 20, herein illustrated by way of example, may be a passenger car, a freight car, or a combination thereof.

Figures 2, 3:
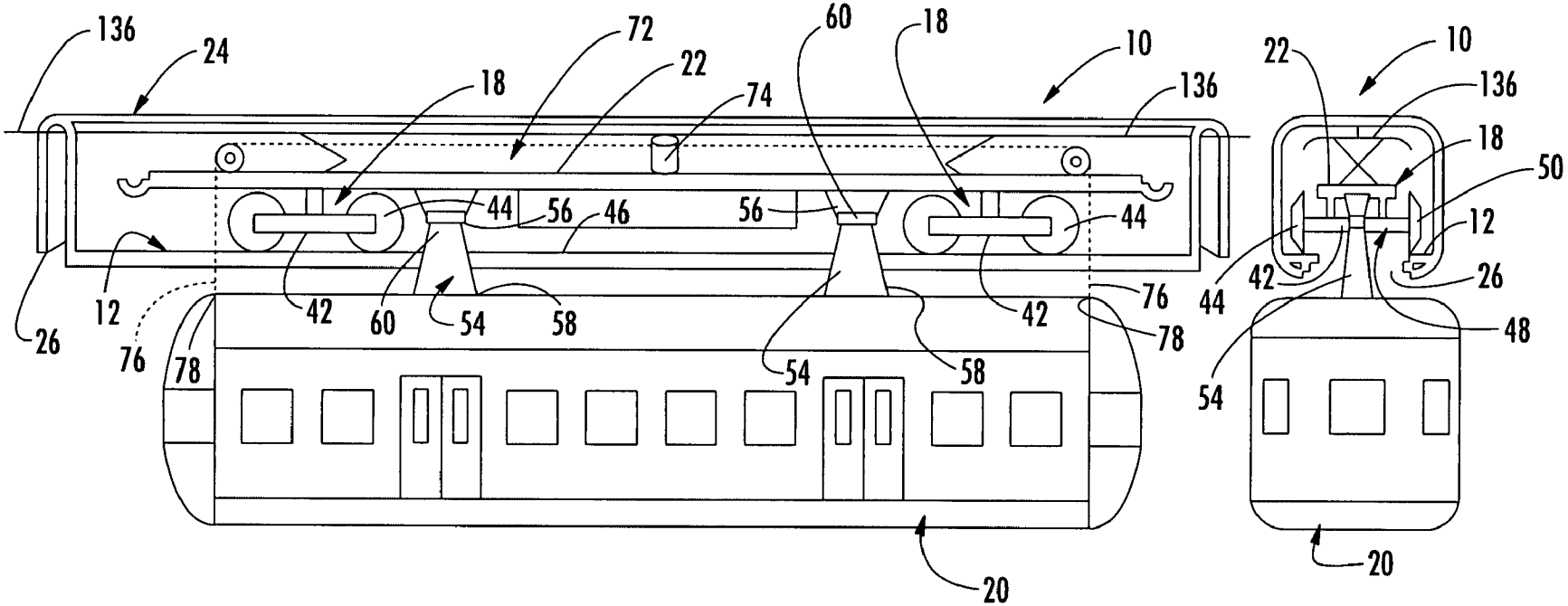
FIG. 2 is a partial cross-sectional, side elevation view of one embodiment of the present invention illustrating elements contained therein.
FIG. 3 is an end elevation view of FIG. 2.
Figure 5:
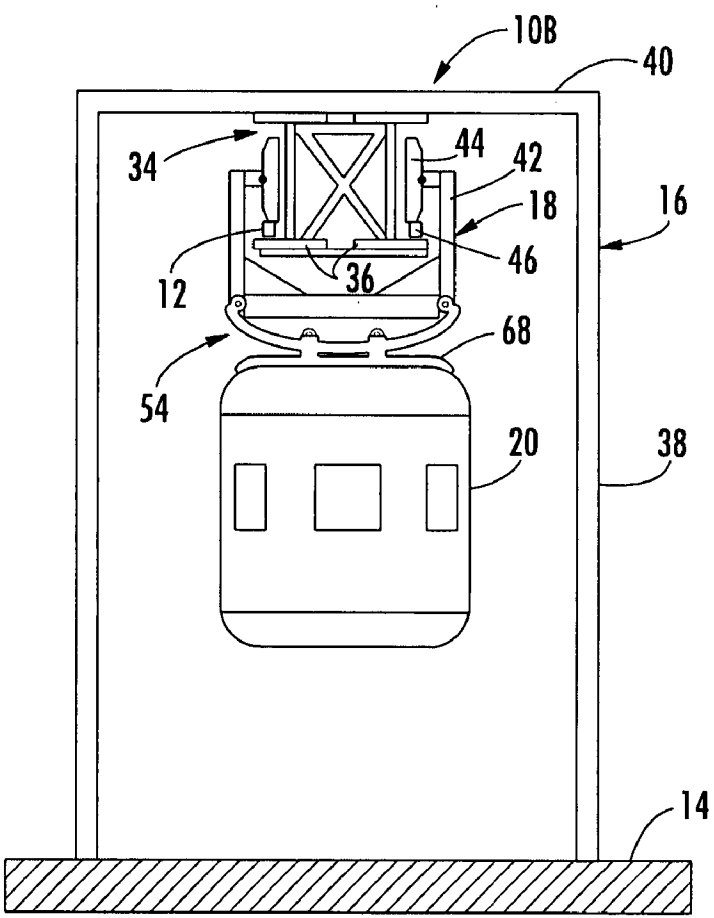
FIGS. 4 and 5 are partial end elevation views of alternate embodiments of the embodiment of FIG. 2 illustrating use of I-beam and double I-beam continuous bridge forming a running surface.
Figure 6:
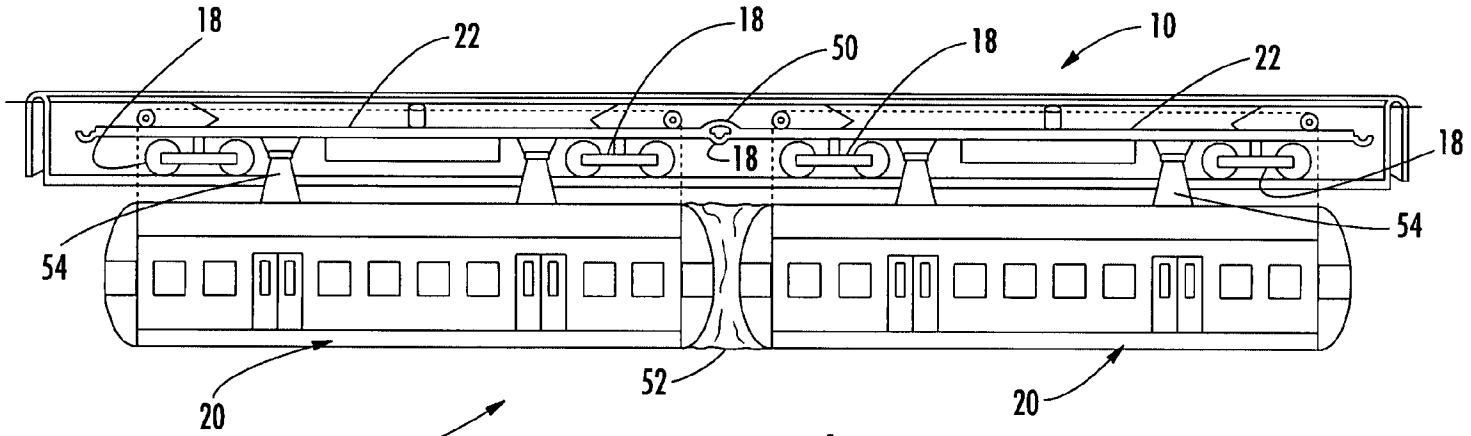
FIGS. 6 and 6A are a partial side elevation views of a combination of carrying vehicles and car bodies joined to form a train, by way of examples.

With continued reference to FIG. 1 and to FIGS. 2 and 3, the system 10 may include a generally U-shaped duct 24 having a slot 26 therein formed by opposing flanged portions 28 of the duct. With the U-shaped duct 24 in an inverted position, an upper surface of the flanged portions may form the running surface 12. As illustrated with reference to FIGS. 4 and 5, and as will be further detailed later in this section, the system 10A may include an I-beam 30 having opposing lower flanged portions 32, the upper surface of which form the running surface 12. Yet further, the system 10B may include an I-beam pair 34 (double I-beam) or truss, having opposing outer flange portions 36, upper surfaces of which, may form the running surface 12. The duct or I-beam structures serve as a continuous bridge or viaduct, typically assembled in sections, and designed to carry the weight of a train 21 of vehicles moving within and suspended below it, as illustrated with reference to FIG. 6 and as will be further described later in this section. The tracks on the running surface may be steel rails similar to those used in traditional railroad services, or in streetcars, subway systems or modern light rail installations, or other forms of running surface on which vehicles may move.

Figure 4:
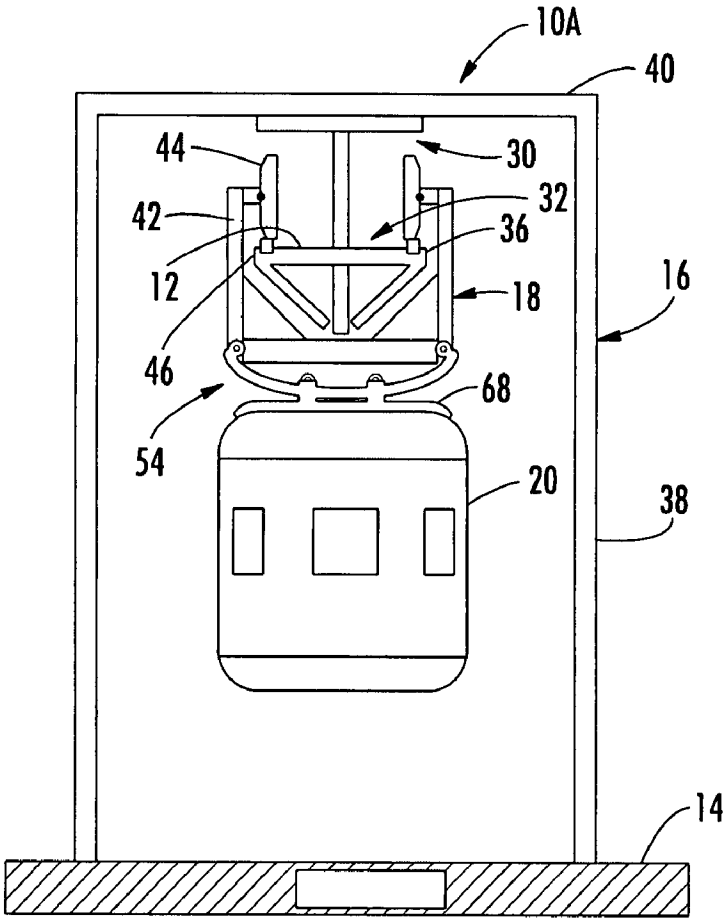

The support structure 16 may comprise a column 38 and cooperating arm portion 40 for supporting the running surface 12 as illustrated by the various supports of FIGS. 1 and 4, herein presented by way of example only. It is expected that the support structure 16 will be built according to a specific environment and will use known engineering standards.

With reference again to FIGS. 2–5, the truck 18 may be described as including a frame 42 having wheels 44 operable therewith for transporting the truck along the running surface 12. A rail pair forming a track 46 may be carried by the running surface 12. For one embodiment herein described by way of example, the wheels 44 and the track 46 may be well known ground level railroad standards, wherein the track and wheels are steel, and wherein each wheel pair 48 is synchronized with each wheel 44 being tapered for self centering while rolling along the track when using the embodiment illustrated with reference again to FIGS. 1–3, by way of example. The tracks 46 may be of different carrying surfaces for steel wheels, roadway wheels, air cushions, magnetic elevating components or other means of movement along the running surface 12.

As will be further detailed later in this section, designated portions of the track may be superelevated. With reference again to FIG. 2, the system 10 includes the chassis 22 carried by two trucks 18. However, a single truck may be used. Yet further, and as illustrated by way of example with reference to FIG. 6, it is expected that a plurality of car bodies 20 will be suspended from a plurality of chassis 22, wherein a coupler 50 on each chassis is used connect an adjacent chassis, and wherein adjacent car bodies are accessible through a walkway 52 permissible because of the controlled longitudinal motion of the car body 20 resulting from the embodiments for a suspension member 54 of the present invention, further described later in this section. Modern rail technology allows the carrying vehicles to use either a truck at each end of the carrying vehicle using two trucks per vehicle or to use single trucks carrying the ends of the adjacent carrying vehicles in an articulating arrangement. This articulation allows two vehicles to share the articulating truck, resulting in a reduction in the total number of wheels required to carry the train. The carrying vehicles moving in the duct or under the "I" beams may have the couplers 50 at each end, allowing them to be coupled together into trains of any length. This also allows for the accurate mating of electrical connections between the carrying vehicles coupled together according to well-established practice for multiple-unit operation for transmitting power and command functions for propulsion and/or to control, heating or air conditioning, refrigeration of the container or freight car, door activation, lighting and communications.

With continued reference to FIGS. 2 and 3, the suspension member 54 suspends the car body 20 from the chassis 22, and may be described as having a proximal end 56 operable with the chassis for attaching and detaching therefrom, and an opposing distal 58 end operable connected to the car body. In one embodiment, the distal end 58 is rigidly affixed to the car body 20. A connector 60 is operable with the suspension member 54 for quickly attaching and detaching the car body 20 from the chassis 22. As illustrated with reference to FIGS. 7 and 8, one embodiment of the connector 60 may include a vise 62 for receiving the suspension member proximal end 56 therein and a turnbuckle 64 for securing the vise in a locking position. Such an arrangement permits quickly attaching and detaching of the car body 20 from the chassis 22, including a quick detaching and attaching of electrical and controls using a mating plug 66 herein described by way of example. By way of example, each car body 20 to be suspended has attachments above the roof 68 thereof to mate with matching attachments 70A, 70B such as an electrical connector, on the underside of each carrying vehicle 72 and roof of car body, the carrying vehicle comprising the truck 18, wheels 44, and the chassis 22, to serve in quickly detaching and attaching the car body using a "latch and lock" styled function to prevent accidental detach. As herein described with reference to FIG. 2 and later in this section, a suspended car body 20 may be detached and replaced with others quickly, easily and conveniently. The carrying vehicle 72 may carry a winch 74 and cable 76 or other lifting system so that the carrying vehicle may raise or lower the suspended bodies 20 in a process that can be partially or wholly automated using a lift connector 78 operable on each car body. Other lifting components such as hydraulic cylinders on the chassis or on the body being lifted may be in addition to or substituted according to local practice.

Figure 8:
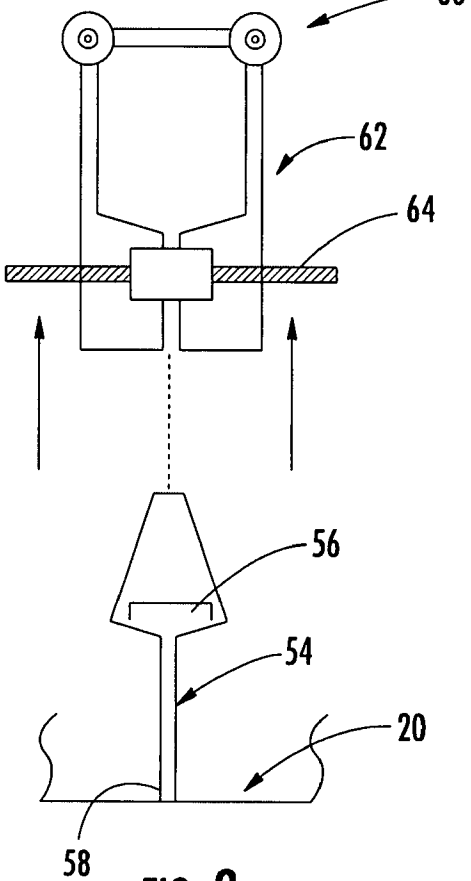
FIGS. 7 and 8 are partial side and end views of one quick detach embodiment of the present invention.
Figure 7:
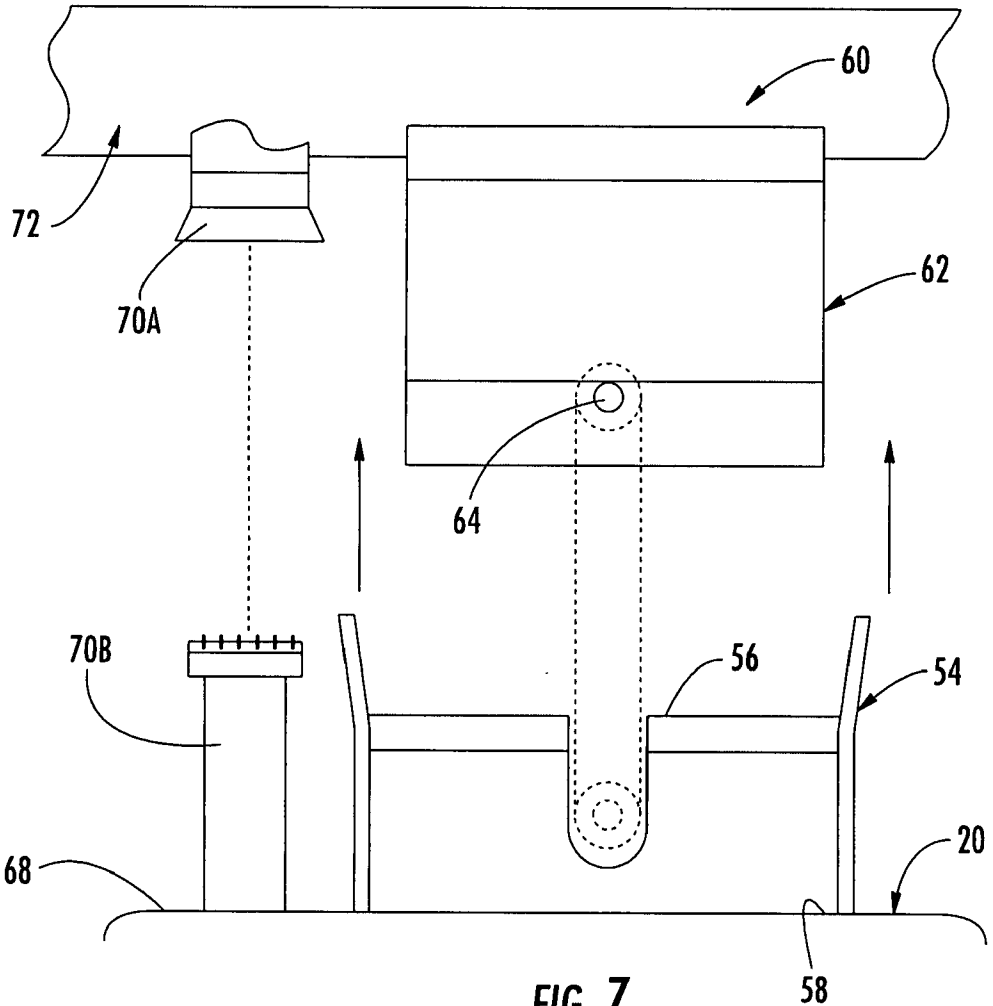

With continued reference to FIGS. 7 and 8, and by way of further description, the suspension member 54 acts as guide plates to lead the car body 20 into place beneath the carrying vehicle 72 when it is lifted into place, and controls the longitudinal freedom of the suspended car body during operation. The attachment 70B, a column holding the electrical connections mates with the matching connections of the attachment 70A on the carrying vehicle above. A group of electric connectors may be provided, normally protected against climatic conditions by a cover when not suspended, but exposed when the cover is opened by human or automatic means as the body is being lifted towards the carrying vehicle. The connectors may be incorporated as an integral part of the quick detach. Member attached to the carrying vehicle from which the clamping components of the carrying vehicle are hinged, and may be an integral component of the chassis, or may be hinged or pivoted to allow the car body to swing laterally under the effect of centrifugal forces. Hinge pins support the load transmitted from the car body below. Clamping components hold the support in place and thus the suspended car body. A load-carrying surface of the clamping components mattes with the corresponding surfaces of the car body. The turnbuckle 64 opens and closes the clamping components to receive or retain the load-carrying members of the car body. More than one turnbuckle 64 may be installed for security in redundancy. The turnbuckle may be turned by hand or may be motorized as part of an automatic operation. Clearance space in the support member allows it to pass the turnbuckle as it is lifted upwards into the clamping components. The group of electrical connectors may mate with the corresponding connector(s) on the car body while they are attached together. A shroud guides the electric connectors into place and protects the contact interface when connected.

The car body 20 may be lifted up by crane or fork-lift truck or other lifting device to attach it to the chassis 22, or the chassis of the carrying vehicle 72 may alternatively be provided with the winch and cable herein in described, or other lifting device such as pneumatic cylinders whereby the carrying vehicle may raise or lower the car body without other mechanical assistance, facilitating exchange of bodies, or allowing operation of the carrying vehicle without a car body attached beneath it. By way of example, when the carrying vehicle is not carrying a car body, the portion of the attachment that remains with the carrying vehicle may not project below the railhead (top of the track), enabling the carrying vehicle without the car body on flat floors or other surfaces allowing the use of standard rail car repair shops. The detached car bodies can be lowered on to any form of rail or road vehicle for transportation into the same shop or another body shop. The quick attach and detach incorporated into the suspension are optional as are winches, pneumatic devices and cables on the chassis to raise or lower the car bodies without outside assistance.

With reference again to FIGS. 4 and 5, and now to FIGS. 9A–16, the suspension member 54 may have alternate embodiments in keeping with the present invention, embodiments of some are herein described by way of example, and may be described as including a first support 80 carried by the chassis 22 and a linking arm 82 connected between the car body 20 and the first support.

Figure 9A:
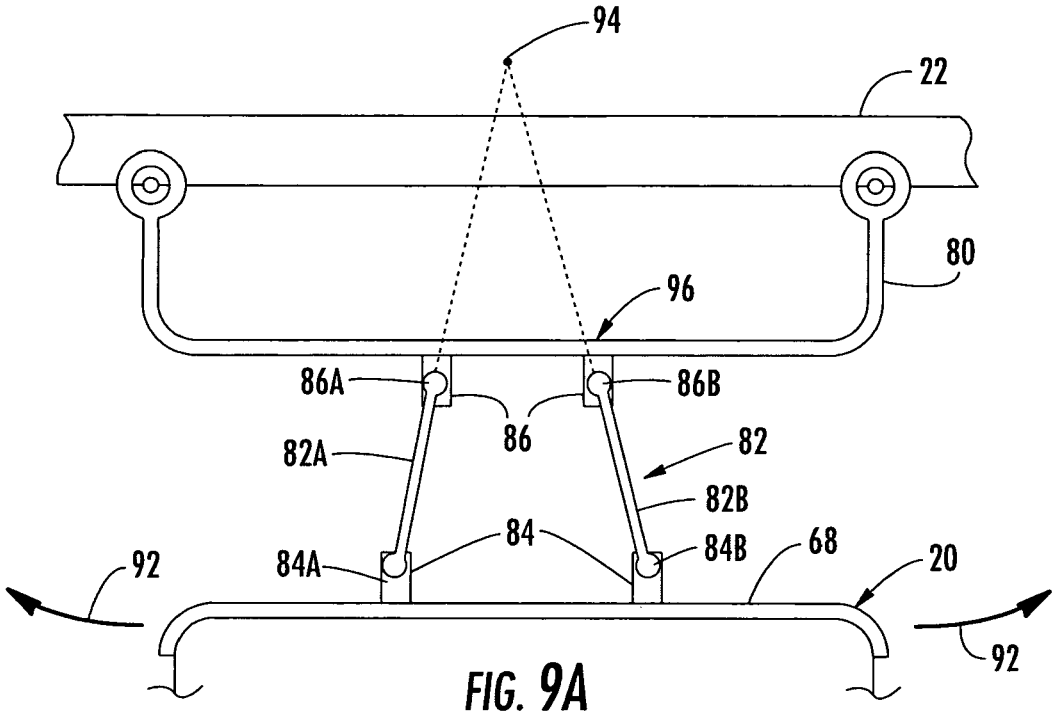
FIGS. 9A and 9B are diagrammatical illustrations of mechanical linkage creating a center of rotation in keeping with the teachings of the present invention.
Figure 9B:
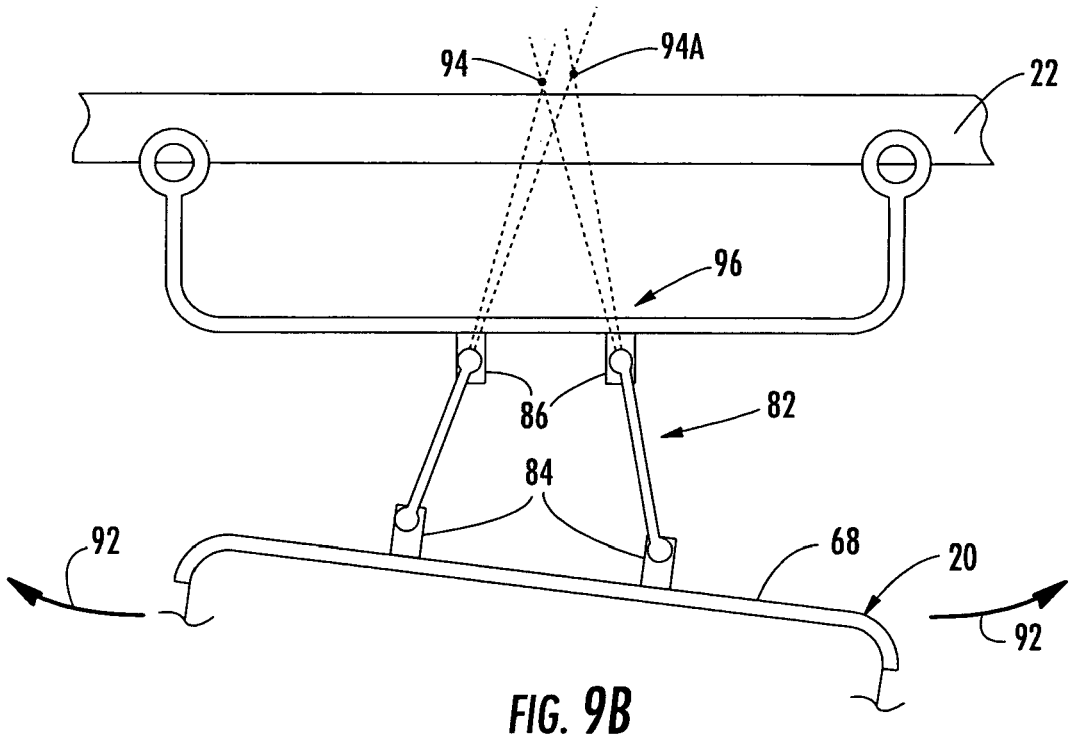

With reference to FIGS. 9A and 9B, a first bracket pair 84 may be affixed to the roof 68 of the car body 20 and a second bracket pair 86 affixed to the first support 80, wherein the linking arm 82 comprises a linking arm pair 82A, 82B, each having proximal and distal ends 88, 90 slidably connected to the first and second brackets 84A, 84B, 86A, 86B of the first and second bracket pairs 84, 86 for providing a lateral movement or rotation 92 of the car body 20 about a center of rotation 94 located above an actual pivot connection location 96 and above the chassis 22. The center of rotation 94 may be viewed as a "virtual" center of rotation. For the embodiment illustrated with reference to FIGS. 9A and 9B, the center of rotation 94 is laterally displaced to 94A during rotation of the car body 20. With reference again to FIG. 9A, it will be understood by those skilled in the art that the fixed or flexible connections, pins and bushes, hinges, or other devices that form connections allow pivoting at the connecting points. For minimal displacements, the lower body suffers both a lateral displacement and a rotation near the virtual center of rotation. For larger displacements, the effective center of rotation also is displaced, thereby diminishing the effectiveness of the device.

Figure 10A:
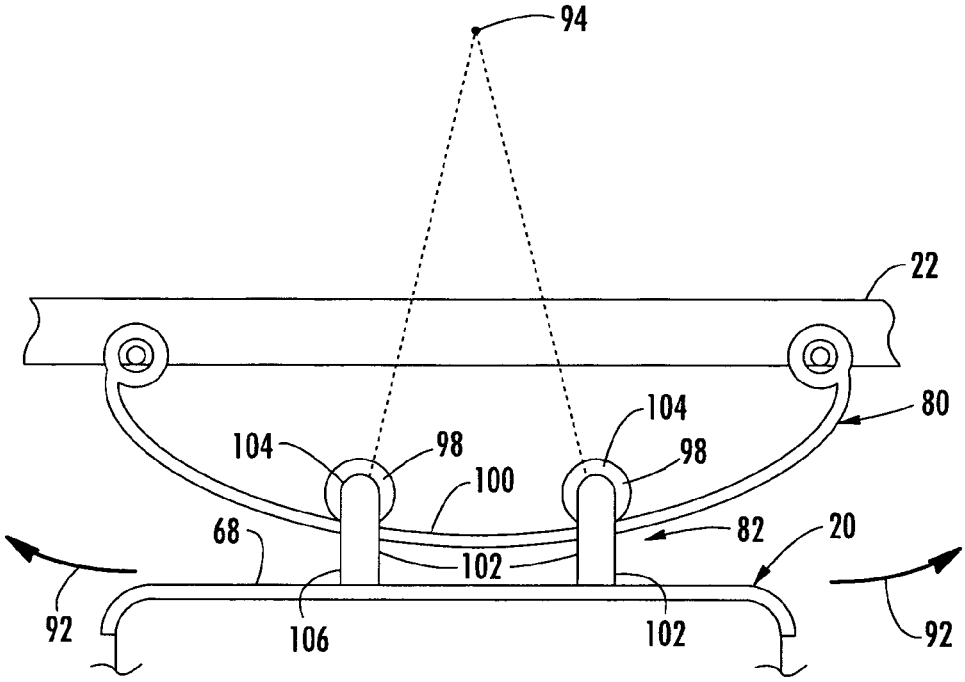
FIGS. 10A, 10B, 11A, and 11B are diagrammatical illustrations using arcuate surfaces for creating a center of rotation in keeping with the teachings of the present invention.
Figure 10B:
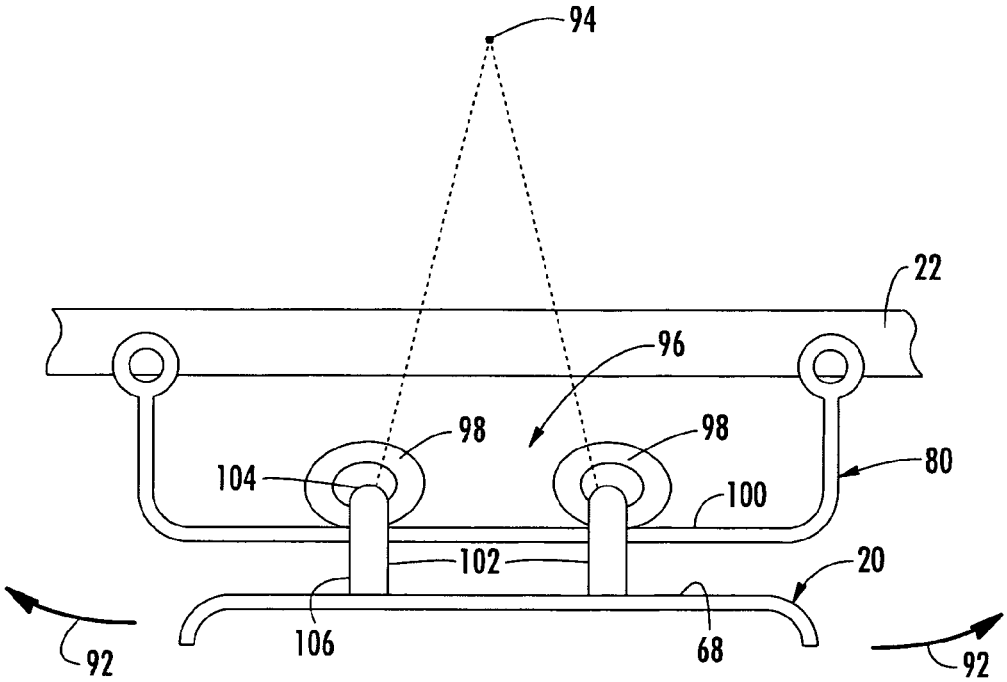
Figure 11A:
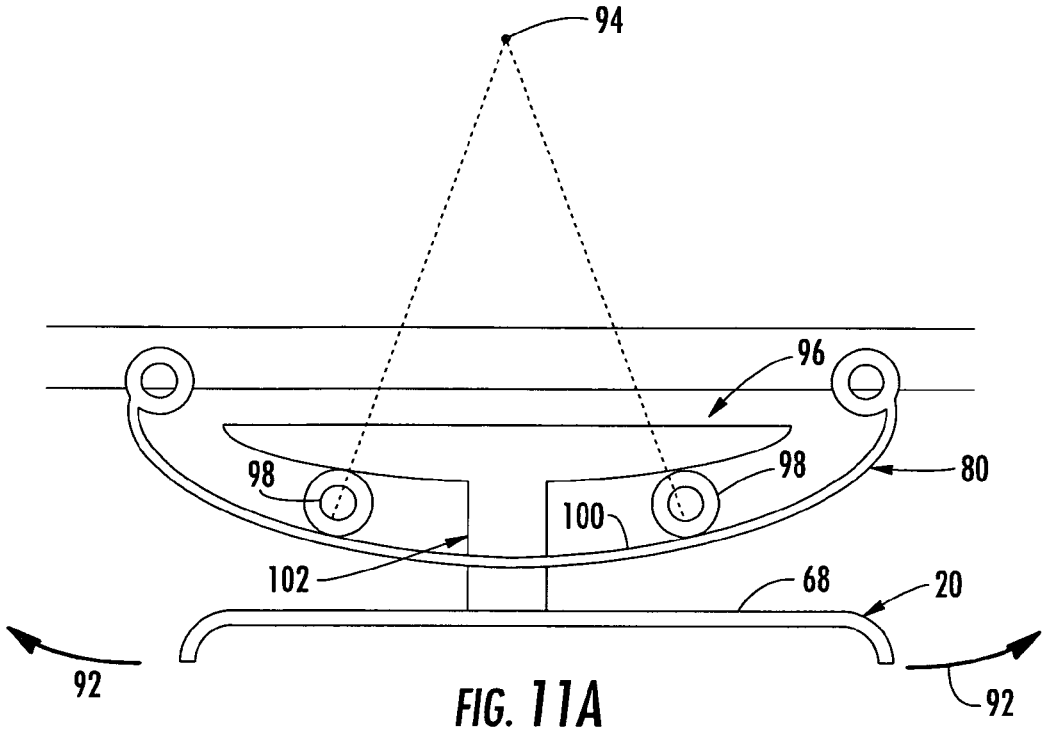
Figure 11B:
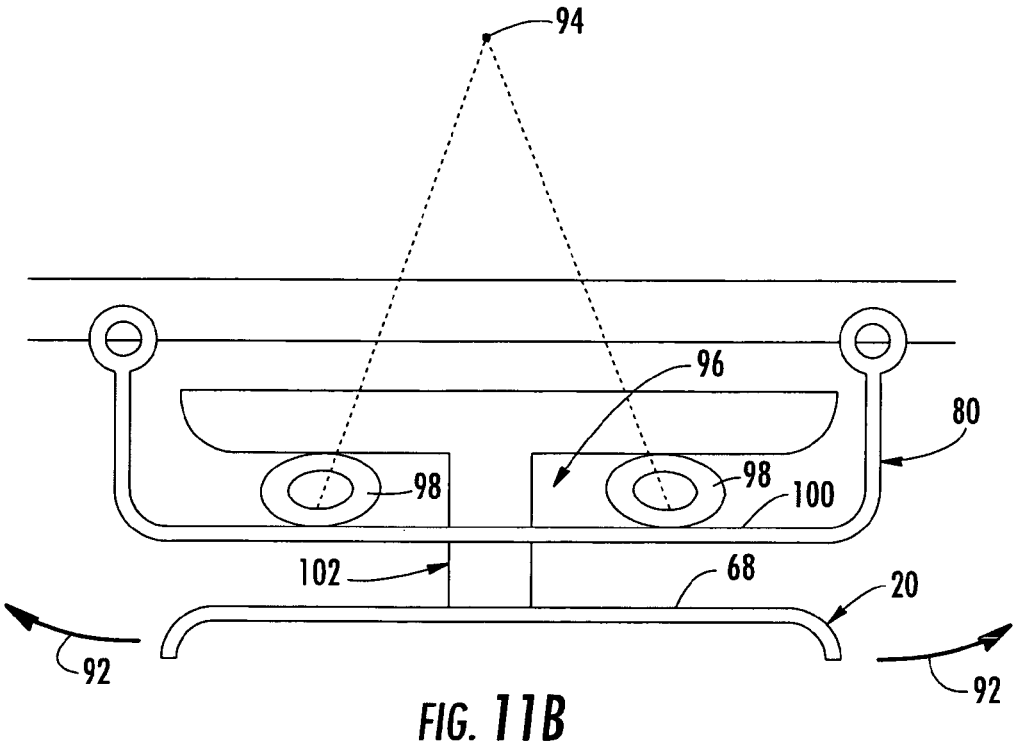
Figure 12A:
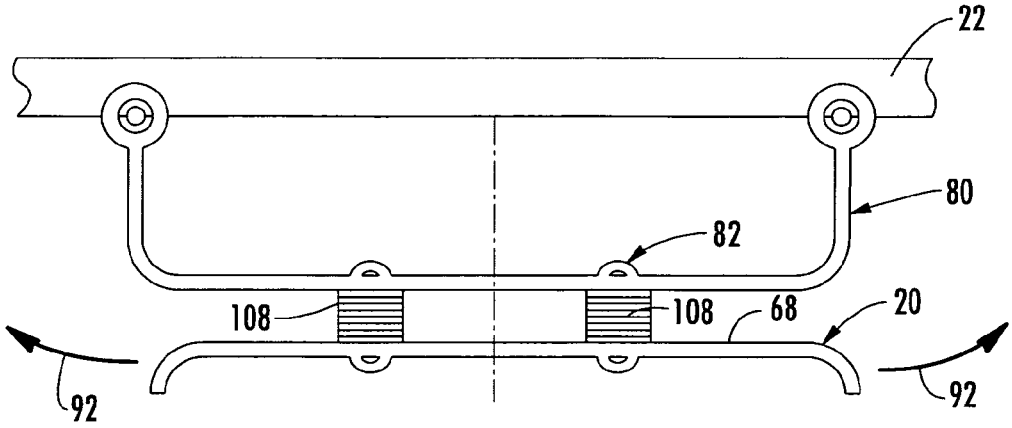
FIGS. 12A and 12B are diagrammatical illustrations using adjustable springs, pistons, and the like for providing a center of rotation in keeping with the teachings of the present invention.
Figure 12B:
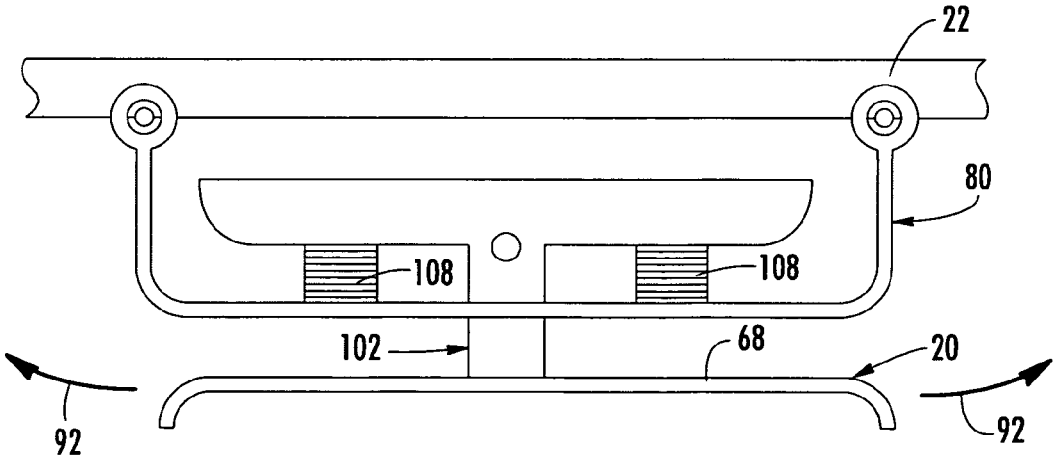

With reference to FIG. 10A, an arcuate member 98 may be used for rotatably connection with a surface 100 of the first support 80. A bracket 102 may have a proximal end 104 rotatably operable with the arcuate member 98 and a distal end 106 affixed to the car body 20. As illustrated with reference again to FIG. 10, the surface 100 of the first support 80 may comprises a concave shape for receiving the arcuate member 98, or alternately as illustrated with reference to FIG. 10B, may be generally flat. Further, the arcuate member 98 may be circular in cross section as illustrated by way of example with reference again to FIG. 10A, or oval as illustrated with reference to FIG. 10B, or other arcuate shape as may come to the mind of those skilled in the art now having the benefit of the teachings of the present invention such as the embodiments of FIGS. 11A and 11B, by way of further example. When displaced sideways, the leading wheel rolls on to a larger radius, causing the body to lift on that side, while the wheel on the trailing side rolls on to a smaller radius, lowering the body on that side, creating a virtual center of rotation at the center of concavity, when the body is displaced sideways. With such an embodiment, the potential angle of rotation may be increased while the physical radius of rotation is reduced. Yet further, and with reference to FIGS. 12A and 12B, the linking arm 82 may comprise a spring, a piston, or a combination 108 thereof. By way of further example, the suspension member 54 may include the arcuate members 98 or other means that allow sideway movement on the curved surface, allowing the car body to roll under the effect of centrifugal forces. Damping may be incorporated to minimize continued oscillations. The only force tending to return the body to the vertical position is the force of gravity. As a result, the springs perform a damping function during an outward swing and suppress continuing oscillation.

It is an option of the design that, at any point in its length, the suspension member may incorporate a connecting point capable of serving as the hinge or pivot of a pendulum to allow the body to swing outward without depending on the rolling effect of the top beam o the car body. This hinge or pivot may require an added feature to ensure damping to prevent oscillation or to enhance swing-out. We define this feature as a swing damper.

Consider the technology of the pure pendulum. When the moving vehicle of the OSLR system enters a curve following along a track or line of roadway, the inertia of the suspended body would continue in a straight line, but the curving track or roadway causes a lateral displacement of the carrying vehicle above. This applies a sideways force at the point of attachment that pulls the body sideways into the curve, while the inertia in the bodies causes a tilting motion and a swing out that compensates for the centrifugal forces of the curving motion. The vertical distance between the point of attachment and the center of gravity of the car body should be sufficient so that the inertia of the vehicle pulls sideways at the point of attachment and creates a torque causing the tilting of the body and outward swing on the curve. This creates the action of a pendulum. The effectiveness of lateral swing is related directly to the effective length of the pendulum and the centrifugal forces applied. The center of attachment may use a mechanical pivot point or bearing, or may use mechanical linkages that can create virtual centers of rotation at distances higher than the actual points of suspension. If the pendulum principle is used for bottom-supported vehicles, the point of attachment should be far enough above the center of gravity of the car body to ensure that the effective length of the pendulum shall be adequate. It is also envisioned that both tilting assistance and damping might be used to increase passenger comfort. This pre-emptive tilting is especially important if the track does not allow a suggested 6-second transition curve.

Consider incorporating a "virtual" center of rotation principle, wherein a virtual center of rotation is created when a body is carried so that it can be caused to rotate as if supported like a pendulum from a center of rotation above or below the point of attachment. This principle can be added into the physical mounting of an actual pendulum to create an effective length longer than the actual pendulum attachment offers. There are many forms of mechanism capable of rotating a body around a virtual center of rotation when required. Since a virtual center is not central to the body, there are limits of movement for which the simulation remains viable. Each form has its benefits and its limitations. Generally the limitations are on the amount of rotation available, beyond which the simulation becomes invalid.

The distance that the wheels or rollers can move without passing the points of their maximum and minimum radii limits movement. Beyond this point the effect is reversed. With an elliptic wheel or roller on a flat surface, a center of rotation is created at the center of concavity with the body is displaced sideways. The weight of the body is on the wheels or rollers. The roller or wheel may be replaced by a cam and follower system that can control the motion by using a motor system to rotate them. This then allows the mechanical control based on the synthetic curve superimposed in the cam track. These mechanical powered means could take the form of many more examples. For a suspended vehicle much more tilt can be achieved. The fittings may include springs, pneumatic cylinders, hydraulic pistons, cams or combinations of such, allowing variations in their lengths. When one of these fittings is shortened, a body roll is created. The other fitting may be lengthened at the same time, lowering the body on that side, doubling the body-roll effect. There is no need for any center pin or pivot point, but the effect is of a virtual center of rotation at the midpoint between these fixings. Brackets may be springs, pneumatic cylinders, hydraulic pistons cam systems or combinations of both, capable of extension or compression to meet the needs of the operation.

With reference again to FIG. 12B, the springs, pneumatic cylinders, hydraulic pistons cam systems or combinations of both, rest on the upper surface of the first support 80. An extra member attached to the top portion of the bracket 102 suspends the car body 20 beneath a flat member that rests on top of the springs, instead of being suspended, thereby allowing variations in their lengths to change the position of the car body in relation to the first support. When one of these fittings is lengthened, the car body is lifted on that side, creating a body roll. The other fitting may be shortened at the same time, lowering the body on that side, doubling the body-roll effect. There is no need for any center pin or pivot point, but the effect is of a virtual center of rotation at the midpoint between these fittings. The lengths of the cooperating fittings herein described by way of example will govern location of the center of rotation. Virtual centers of rotation provide effective lengths of pendulums for enhancing the performance on curves of overhead-suspended transportation vehicles.

Some modern bottom-supported rail passenger vehicles have suspension of car bodies at points of attachment below the roof of the car. Problems have been found in the short vertical distance between the point of attachment and the location of the wheels at track level. The pendulum effect may be inadequate to achieve a natural swing out, so that powered tilt also has been applied. In the case of bottom-supported vehicles with obstructions beside the line of route, usually there is a physical limitation on the amount of lateral swing that can be allowed. As applied to top-supported vehicles, by way of example, a virtual point of rotation can be established high enough to reduce or avoid needing powered tilt. However this may not overcome the limitations of constrained lateral freedom of movement that may restrict potential benefits. The vehicle takes the form of a carrying vehicle running on a track or tracks overhead. Car bodies may be suspended below, with freedom to swing laterally to achieve the pendulum effect. The effective center of rotation between the car body and the carrying vehicle is to be as high as possible to assure adequate pendulum effect on curving, while functioning within the constraints of any obstructions that may be found alongside the path of movement.

In both circumstances, the freedom for lateral swing will be provided with desirable damping to suppress continuing lateral oscillations. Consider, by way of example, a use of this principle in practice, and in particular for the system with reference now to FIGS. 13A–16B, by way of example.

Figure 13B:
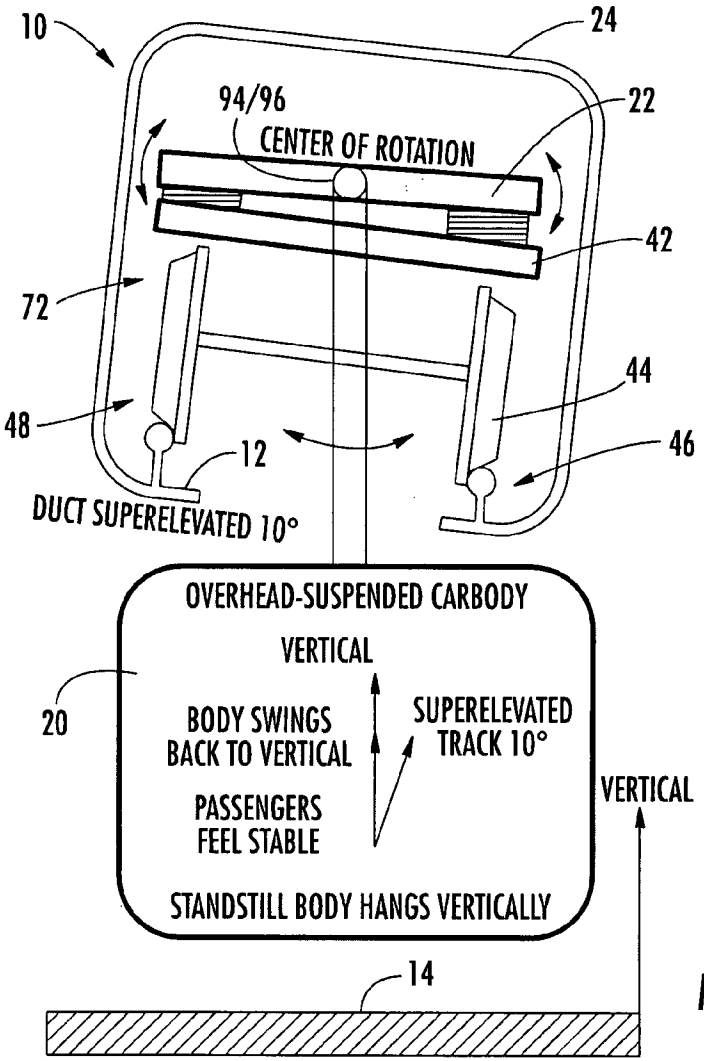
FIGS. 13A–16B are diagrammatical illustrations of OSLR system performance on a curve with and without superelevated track as compared to typical track carried at ground level, wherein FIGS. 13A and 13B address vehicles at standstill on curves having superelevated track, FIGS. 14A and 14B address vehicles traveling on curves without superelevated track, FIGS. 15A and 15B as well as 16A and 16B address vehicles traveling on curves with superelevated track.
Figure 13A:
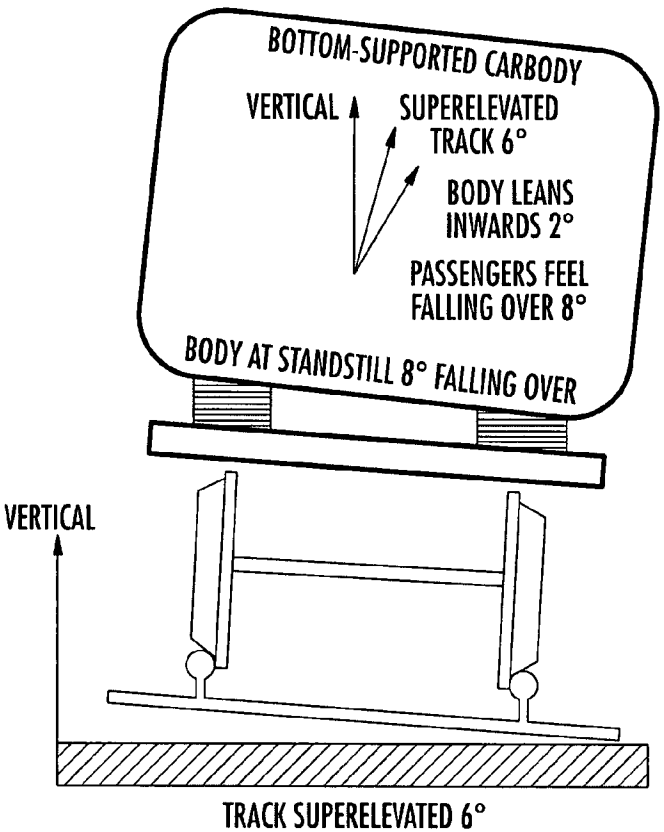

For vehicles 72 at a standstill on a curve, consider the drawings of FIGS. 13A and 13B. In bottom-supported steel rail systems, there are limits on permissible super-elevation of track on curves that impose limits on speed performance. If the car body 20 or train 21 has occasion to come to a standstill on the curve, passengers in the car bodies will feel the car body leaning towards the center by the amount of the super-elevation plus the tendency of the car body to lean further over by the elasticity of the car springs. Because of freight requirements, most track in the Americas is only superelevated to 4°. Dedicated passenger operators have accepted that the acceptable super-elevation is set at 6° of angle. The body is likely to lean a further 2°, so that passengers in a bottom-supported car at standstill on such a curve are discomforted by the car leaning over by as much as 8° of angle. Current operating practice accepts 6° of super-elevation to be the limit of acceptability for the comfort of passengers in a stationary car. The car that is suspended overhead simply swings back to the vertical position when brought to standstill on a curve. The passengers feel no discomfort, so that passenger comfort does not govern the permissible super-elevation of the track or roadway above. The permissible super-elevation is governed by the limit of friction between the wheels and the track, so that the wheels do not slide down towards the low side of the slope. For the steel wheel system herein described by way of example, this limit is taken as 10° of angle. Tests have shown that it easily exceeds 16 degrees, indicating 10° of super-elevation uses only 62% of this range. The speed difference compared with tracks of 4° superelevation in the Americas is 2 times faster under this condition.

Figure 14B:
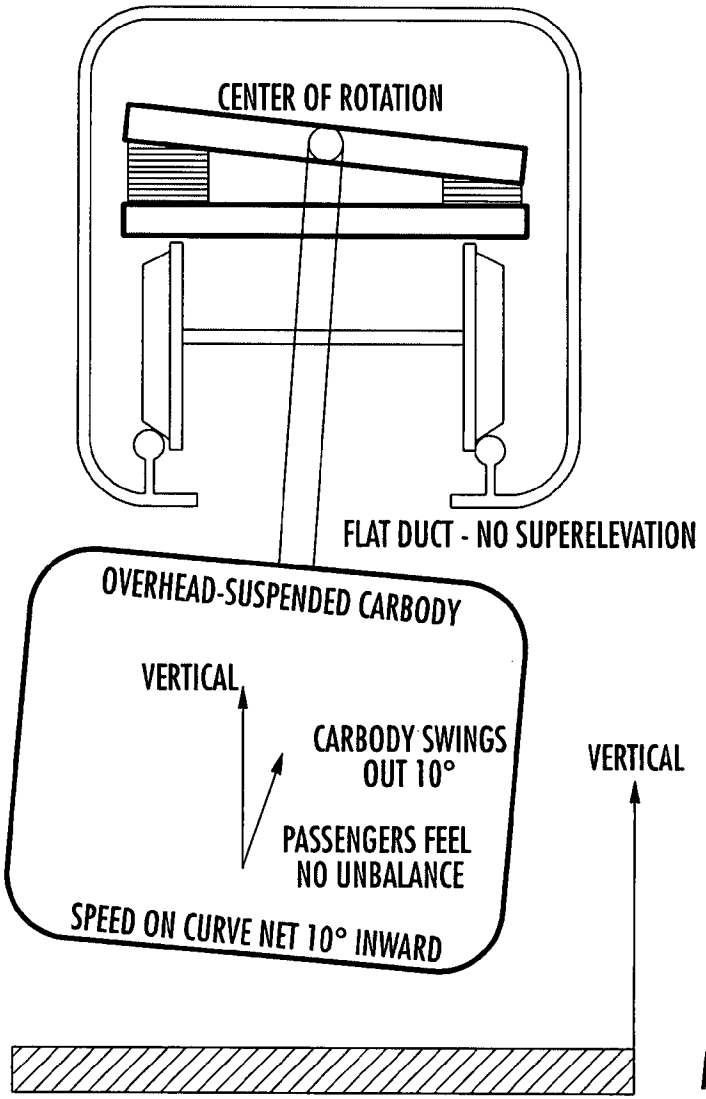
Figure 14A:
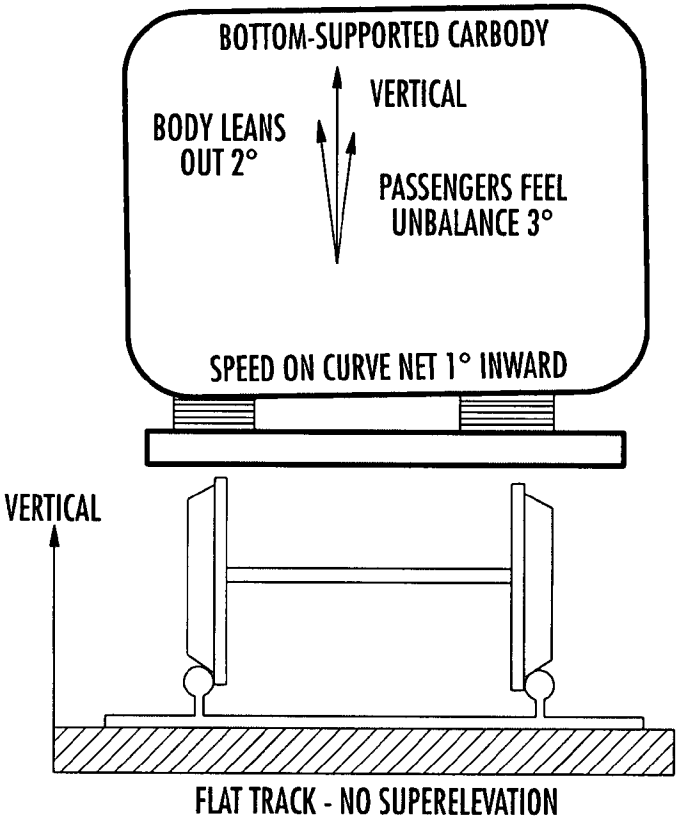

For vehicles moving on curves having no superelevation, consider the drawings of FIGS. 14A and 14B. Curves with no super-elevation may be found for light rail systems where the tracks are laid in streets or paved roadways that require the tracks to be installed flat with the roadway surface. Operators using bottom-supported vehicles on flat curves generally set speed limits such that passengers feel overspeed to the equivalent of 3° of deficiency. The car body may lean away from the curve as much a 2°, so that the net curving speed without super-elevation can rely only upon 1° inward. The system of the present invention having vehicles on flat curves can swing out at a speed that creates an outward force not exceeding a preselected limit of 10°, so that the wheels will not slip towards the outer rail. In this condition the passengers continue to travel in comfort and feel no curving deficiency. The net curving speed can be based on 10° inward. The speed ratio is 3.2, so the overhead-suspended vehicle can go round the curve over three times faster than the bottom-supported vehicle.

Figure 15B:
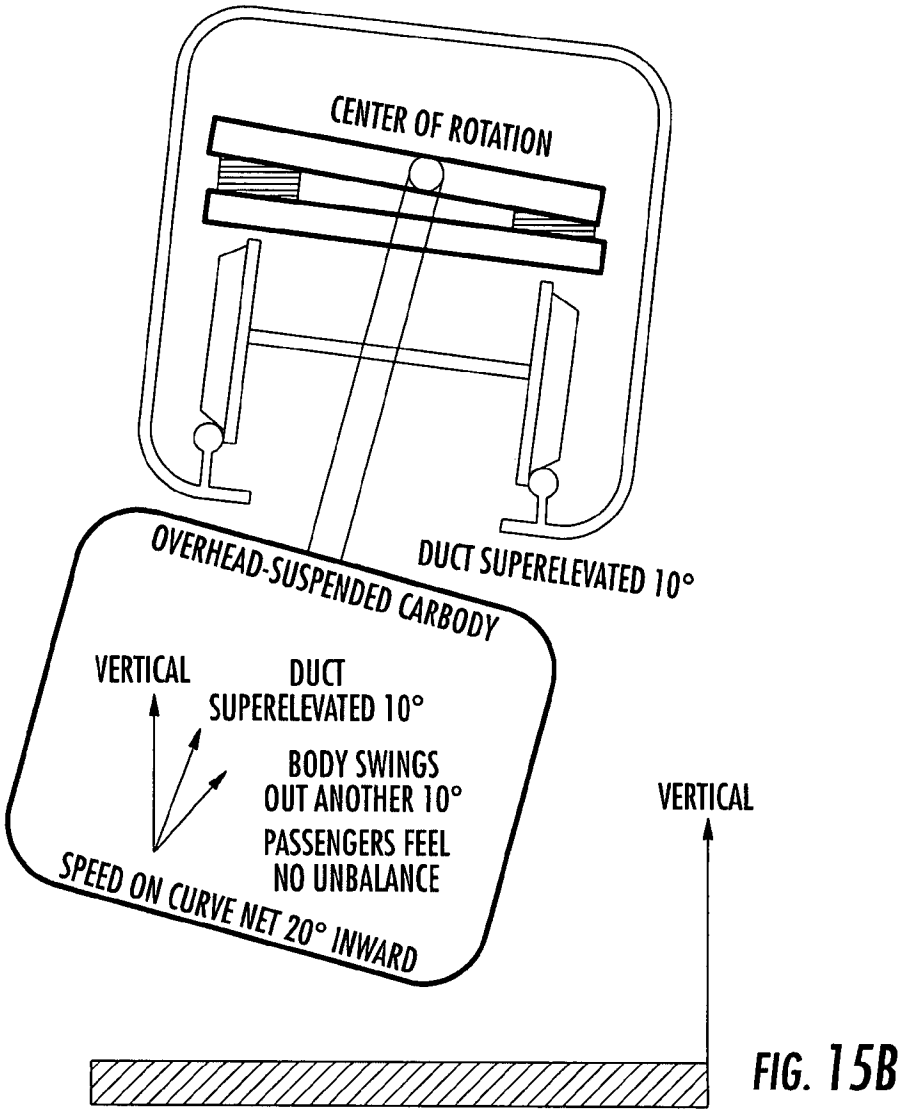
Figure 15A:
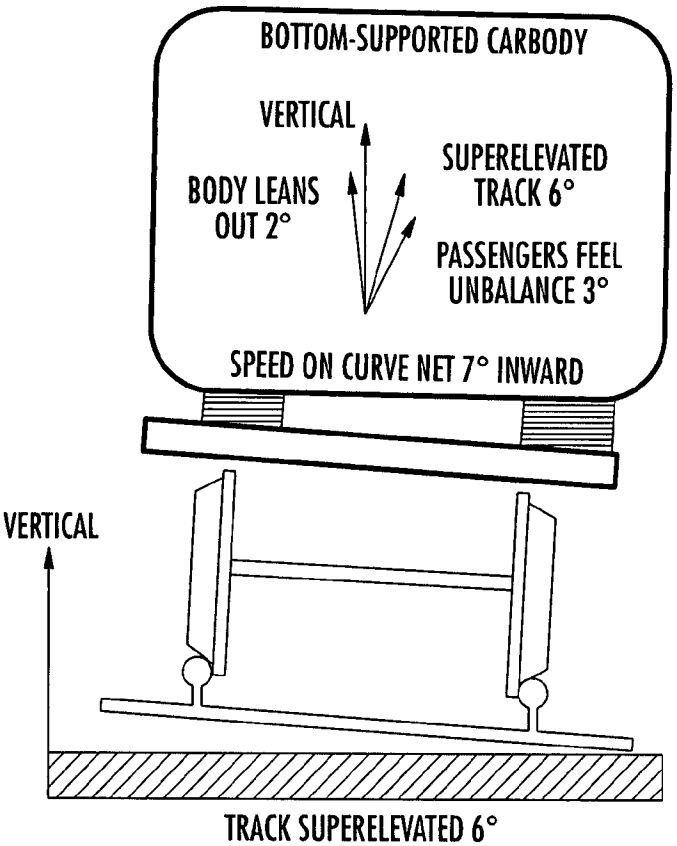

For curves having a desirable superelevation, consider the drawings of FIGS. 15A and 15B. For bottom-supported vehicles on curves with 6° of super-elevation, the passengers are expected to feel 3° of deficiency, while the car body can lean outwards by 2°, so the net curving speed is based upon 7° of super-elevation. The overhead-suspended vehicles on curves with track super-elevation 10° can swing out by a further 10°, so the curving speed relates to 20° of super-elevation. The speed ratio is 1.67, or the overhead suspension allows curve speeds 67% faster.

Figure 16B:
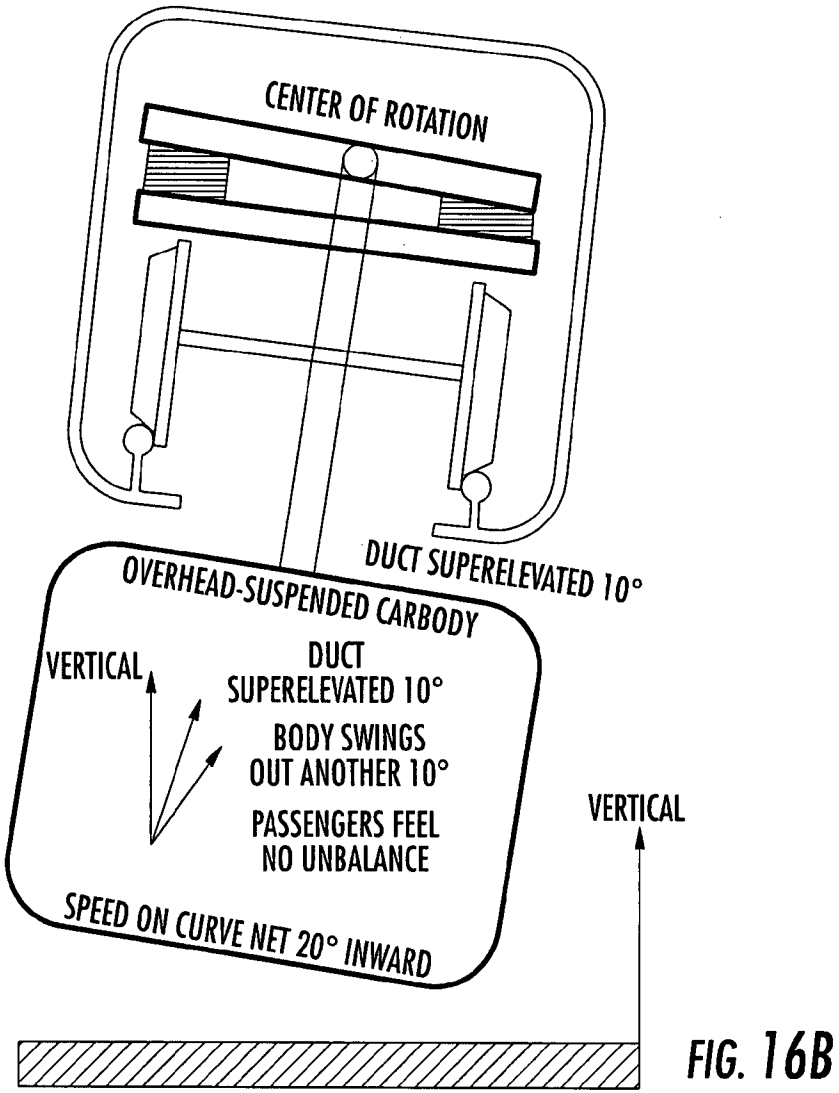
Figure 16A:
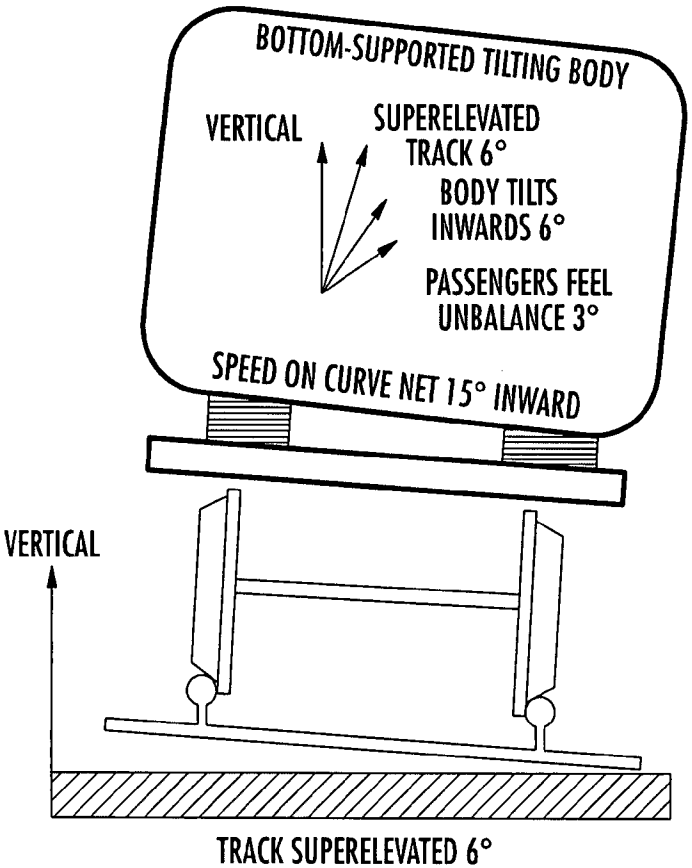

By way of further example, consider tilting bodies on curves with a "maximum" acceptable superelevation with reference to FIGS. 16A and 16B. Power tilt above the wheels has been developed in bottom-supported vehicles where bodies are tilted for faster curving while improving comfort for the passengers. Published data for cars with tilt mechanisms show up to 6° of tilt added above the track super-elevation. On curves with super-elevation of 6° and overspeed of a further 3°, this allows a net curving speed equivalent to 15° of super-elevation. The overhead-suspended vehicle for the embodiment of the system herein described for the present invention runs this curve at the same 20° as in the previous example. The speed ratio is 1.15, or 15% faster than the bottom-supported vehicle.

TABLE 1

Vehicle speeds on curves: comparisons of speed performance
Speeds of bottom-supported, tilting body and overhead-suspended vehicles

| | Effective degrees of super-elevation | Calculated speed performance on Curves | | | |
|---|---|---|---|---|---|
| Degrees of curvature | | 5 | 10 | 15 | 20 |
| Radius of curve (feet) | | 1146 | 573 | 382 | 286.5 |
| Both tracks with zero superelevation (Sky Train body swings out 10 degrees) | | | | | |
| Bottom-supported non-tilting speed mph | 1 | 17.3 | 12.2 | 10 | 8.6 |
| Bottom-supported tilting body speed mph | 9 | 51.9 | 36.7 | 29.9 | Unlikely |
| Sky Train overhead-suspended speed mph | 10 | 54.6 | 38.6 | 31.5 | 27.3 |
| Track at grade 6 degrees superelevation (Sky Train 10 superelevation + 10 swing out) | | | | | |
| Bottom-supported non-tilting speed mph | 7 | 45.7 | 32.3 | 26.4 | 22.9 |
| Bottom-supported tilting body speed mph | 15 | 66.6 | 47.1 | 38.5 | Unlikely |

TABLE 1-continued

Vehicle speeds on curves: comparisons of speed performance
Speeds of bottom-supported, tilting body and overhead-suspended vehicles

| | Effective degrees of super-elevation | Calculated speed performance on Curves | | | |
|---|---|---|---|---|---|
| Sky Train overhead-suspended speed mph | 20 | 76.6 | 54.2 | 44.2 | 38.3 |

Vehicle speeds on curves illustrated by way of example include comparisons of speed performance. By way of supporting example, speed ratios may be calculated with:

Speed ratio (1)=Squ root Sin 10/Sin 1=Squ root 0.1736/0.0174=Squ root 9.9=3.14

Speed ratio (2)=Squ root Sin 20/Sin 7=Squ root 0.3420/0.1218=Squ root 2.806=1.675

Speed ratio (3)=Squ root Sin 20/sin 9=Squ root 0.3420/0.1564=Squ root 2.186=1.48

Speed ratio (4)=Squ root Sin 20/Sin 15=Squ root 0.3420/0.2588=Squ root 1.3214=1.149

With reference to FIGS. 13A–16B, support for enhanced performance of the system is herein provided. With reference again to FIGS. 16A and 16B, a pendulum effect is realized as illustrated by the bottom-supported, tilting-body system traveling at speed on a curve where the track is super-elevated to 6° with a body tilted to a further 6°. These are traditionally limiting values for super-elevation of railroad tracks and the amount of tilt built into a tilting-body vehicle. Steel wheels and fixed axle assembly are provided for the trucks that may be of conventional rail construction. A spring plank, an upper component of the vehicle truck. A tilt mechanism may use adjustable springs, pneumatic cylinders, hydraulic pistons or combinations, normally incorporated in modern truck design and may be elaborated to cause the body to tilt on curves. The car body tilts to compensate for curving forces. Upon entering a curve at the operating speed, a control system on the bottom-supported car adjusts the lengths of the spring or a piston device appropriately, to expand on one side and to contract on the other side. This creates a center of rotation at the mid-point between the springs, with the roll inwards towards the inside of the curve. The tilt of the body does not arrive naturally. The center of rotation is below the center of gravity of the body, obviating any pendulum effect. The lengths of the springs must be powered and controlled separately. Any or all of the techniques described below for virtual centers of rotation may be applied for bottom-supported systems. Usually there is a constraint on lateral displacement of the body, which must remain within the loading gauge of the alignment through which the vehicles are to run. With reference again to FIGS. 16A and 16B, by way of example, an overhead-suspended system is illustrated at speed on a curve where the duct is super-elevated to 10° with the body swung out to a further 10°. Calculations show that this allows curving at a centrifugal force of 0.34 G with assured passenger comfort. For the system herein described, the traditional constraints on super-elevation and body-swing do not apply, allowing the outward swing of the car bodies to be greater than the traditional figures. Using values of 10° for each is an interim selection, derived from preliminary laboratory experiments. Subsequent experience may allow different or greater values to be used. One attribute of the suspended system is that the center of rotation is at a distance well above the roof of the car body to allow adequate pendulum effect allowing the body entering a curve to swing out naturally under centrifugal forces As earlier discussed, it is expected that the duct or running surface will be suspended by any desired means, such as portals, "T" columns or cantilevered columns, ceilings of building or tunnels, suspending bridge beams, or girders as is typical suspension methods.

Upon entering a curve at the appropriate speed, centrifugal force can hold the body outwards from the track by 10° in addition to the 10° of super-elevation, so that effectively the body can be swung out to a total 20°.

With a typical spring effect, a restoring force is created, tending to return the body to a neutral position as described with reference again to FIG. 16B. This may not be desirable. As a result, embodiments of the present invention provide for a change in lengths of the suspension member without developing restoring forces. The weight of the body is carried below, while presenting equal distribution of loading. This allows the body to swing freely outwards solely under the gravitational and centrifugal forces.

This transverse movement or tilt may be augmented by adding a force to stimulate the tilting motion early as in a tilt train mechanism in the case where curves do not allow a long enough transition segment.

The assembly of the car body 20 and the carrying vehicle 72 together allows the center of rotation for the outward swing to be located at the highest point above the center of gravity of the car body, which is most desirable for performance in curves.

Relatively high superelevation is permissible for the system 10. In bottom-supported systems, superelevation usually is limited to 6° by comfort conditions in case a vehicle becomes stationary on a curve. These considerations of comfort in vehicles stationary on curves do not apply to overhead-suspended systems. In case of a suspended vehicle stopping on a curve the suspended car simply returns to the vertical position. The limit on super-elevation depends upon the friction between the vehicle and the track, such that the downward force of gravity should not cause the vehicle to slip sideways down towards the lower side. The coefficient of friction of steel wheels on steel rails is known to be greater than the selected super-elevation would require. Laboratory experiments using ⅛-scale models were performed by tilting the track with steel-wheel trucks on steel rails to measure the angle of super-elevation when the wheels first slipped across the track. The results measured this angle to be not less than 16.23°. The diagrams and calculations in this submission are based conservatively upon the admissible super-elevation being 10°, approximately 10 inches on standard gauge of 56½ inches.

Operating up to 10° of super-elevation uses only 62% of this range. If at any time the angle of slip might be exceeded, the flanges slide towards the rail and the slip controlled by the flanges of the wheels. Although rail stability must be taken into account, in view of the margins in angles of slip found in this experiment, it is quite reasonable to continue using 10° for planning purposes. Apparently using 10° for super-elevation and for outward swing is quite conservative.

High swinging out of the car body will be permissible. Centrifugal force creates an outward force on the truck and track. The limit is to prevent the wheels from sliding sideways up towards the high side. The value presently adopted is the same: 10° of outward swing in addition to the super-elevation of the track, allowing a total 20° of outward swing, equivalent to a centrifugal force of 0.34G. The accepted value of outward swing governs the limit of speed and comfort on a curve.

The system for enhanced performance on curves applies modern and fully developed components from modern transportation systems, and to that extent must be considered fully mature. The steel wheel vehicle concept is fully developed in bottom-supported vehicles. The new aspect is the engineering of the same components into a suspended vehicle with the point of attachment sufficiently above the car body to accommodate adequate tilt and swing-out. The car bodies are suspended at a selected height from the roof of the car upwards, with a damped freedom to swing outwards on curves for comfort at curving speeds faster than bottom-supported vehicles and all known overhead-suspended vehicles, with no lateral forces felt by passengers, as in an airplane banking.

The required adaptation would be for engineering design and field-testing to assemble proven components in the new format. At least one curve would be incorporated in the field tests. The location of the curve would be where the vehicle could attain a speed demanding 20° of super-elevation. The super-elevation of the rails would be 10°. Transition curves are suggested, long enough to allow the swing of the bodies to assume the full swing-out position. Calculations indicate the length of transition curve is likely to be of the order of six seconds of journey time. Field-testing may be used to measure the performance and determine the required characteristics of the lateral freedom and damping of the suspension system. Also field testing will determine what may be the further limits of lateral adhesion controlling admissible super-elevation on overhead tracks for rubber or steel wheel vehicles at standstill and maximum outward swing for these vehicles at speed on curves.

As illustrated with reference to FIGS. 17 and 18, the system 10 includes a grapple 110 connected to the carrying vehicle 72. The grapple 110 may be considered to replace the car body 20, or in combination with a container 112 carried by the grapple 110, be viewed as the car body. As earlier discussed, it is intended that the car body 20 be viewed as facilitating the transporting of people, freight, or the combination.

Figure 18:
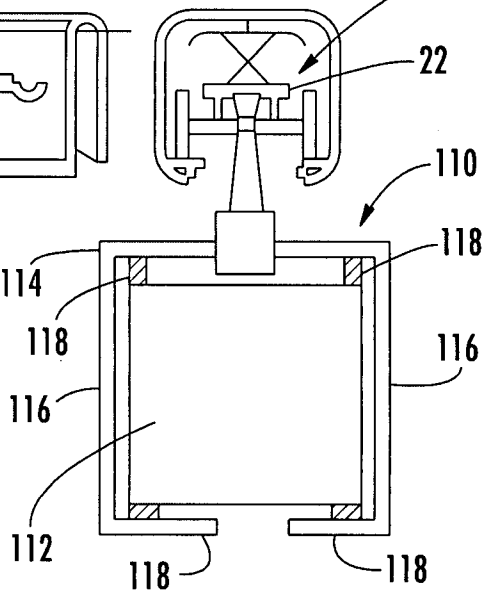
FIGS. 17 and 18 are partial side and end views of a grapple embodiment useful with the carrying vehicle of the present invention.
Figure 17:
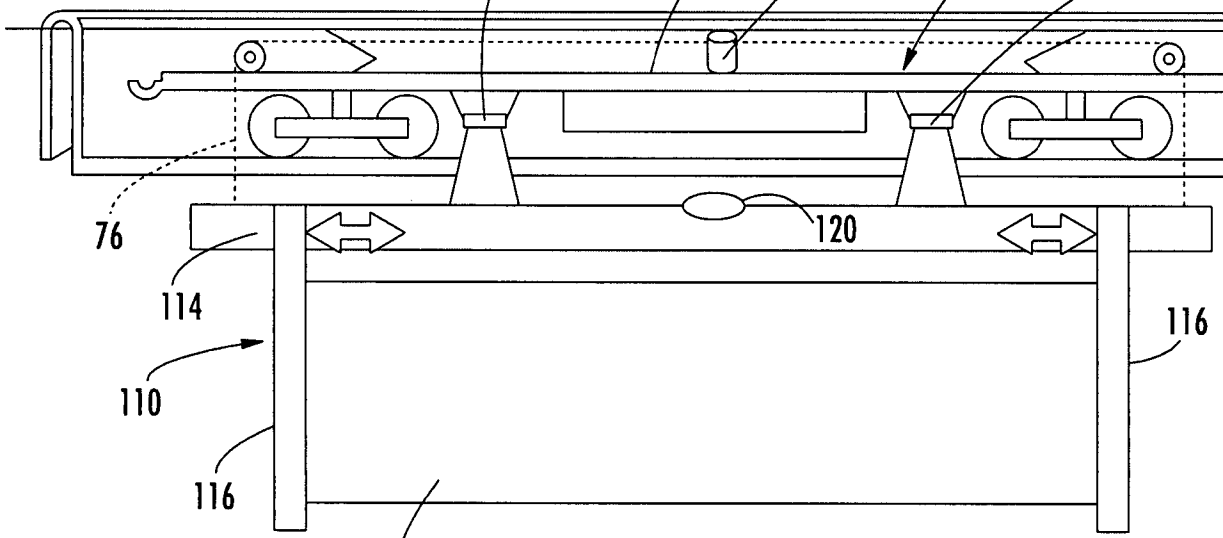

With continued reference to FIGS. 17 and 18, the grapple 110 may include an upper member 114 removably suspended from the chassis 22 and opposing side members 116 slidably connected to the upper member for cradling the container 112 therebetween The grapple 110 may operate using the winch 74 and multiple cables controling 76 for lifting the grapple 110 into place for connecting to the carrying vehicle 72. Alternatively, the grapple or a grapple adaptor may be stored in a container yard and handled by a crane, forklift truck or other transportation machine. The side members 116 of the grapple guide and restrain in place, a freight body or container 112 being transported in the grapple. The upper member 114 of the grapple guides and restrains the container in place. Movable top-handling members 118 secure and lock to the container in place, by way of example. Lower movable members 118 of the grapple add redundant safety to also carry the weight of the freight body or container being transported. A lifting attachment 120 may be incorporated within the grapple 110 for ease of use by a crane, by way of example.

Figure 20:
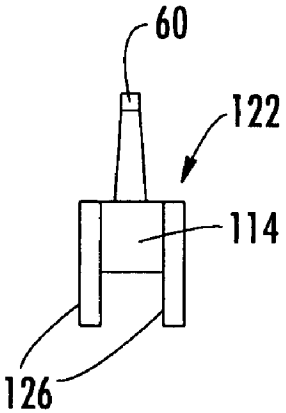
FIGS. 19 and 20 are partial side and end views of a grapple styled adaptor embodiment useful with the carrying vehicle of the present invention.
Figure 19:
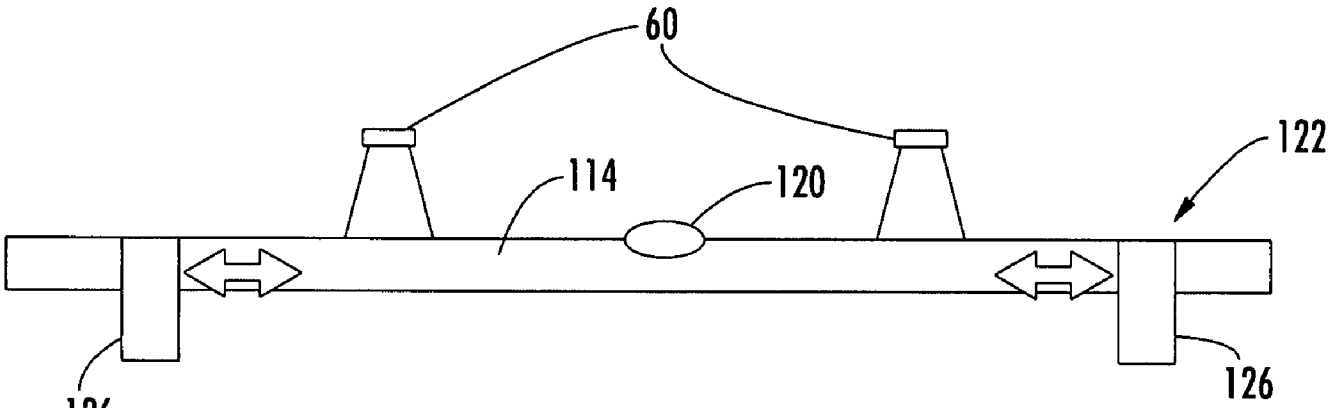

With reference to FIGS. 19 and 20, an adaptor 122 may be used for carrying known grapples. By way of example, the adaptor 122 may include the upper member 114 and lift attachment 120 as earlier described with reference to FIGS. 17 and 18, and attached to the carrying vehicle 72 as earlier described with reference to the quick connection of FIGS. 7 and 8, by way of example. Attachments 126 on the upper member 114 take hold of and carry a conventional grapple without requiring modification thereto.

With reference again to FIG. 17, by way of example, the winch 74 and two or more cables 76 relieves the weight of the car body, the grapple, or adaptor from the quick-detach 60, to allow it to be unlocked. The winch pays out the cable to lower the suspended body to the ground or on to some other vehicle to carry it away. By way of further example, the adaptor 122 can take a strong hold and raise or lower a grapple below, enabling the grapple to hold a container or other commodity while the commodity, the grapple and the grapple adaptor are raised up as an assembly with cables or other means attached alternately to the grapple or to the compatible portions of the quick detach on the carrying vehicle in the duct above.

Figure 21:
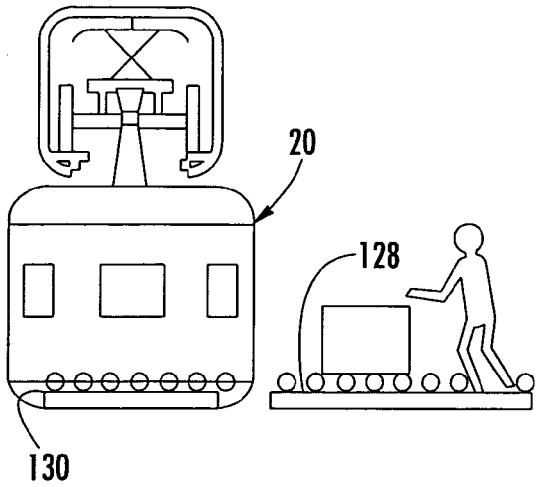
FIG. 21 is a partial side view illustrating a loading of a car body.
Figure 22:
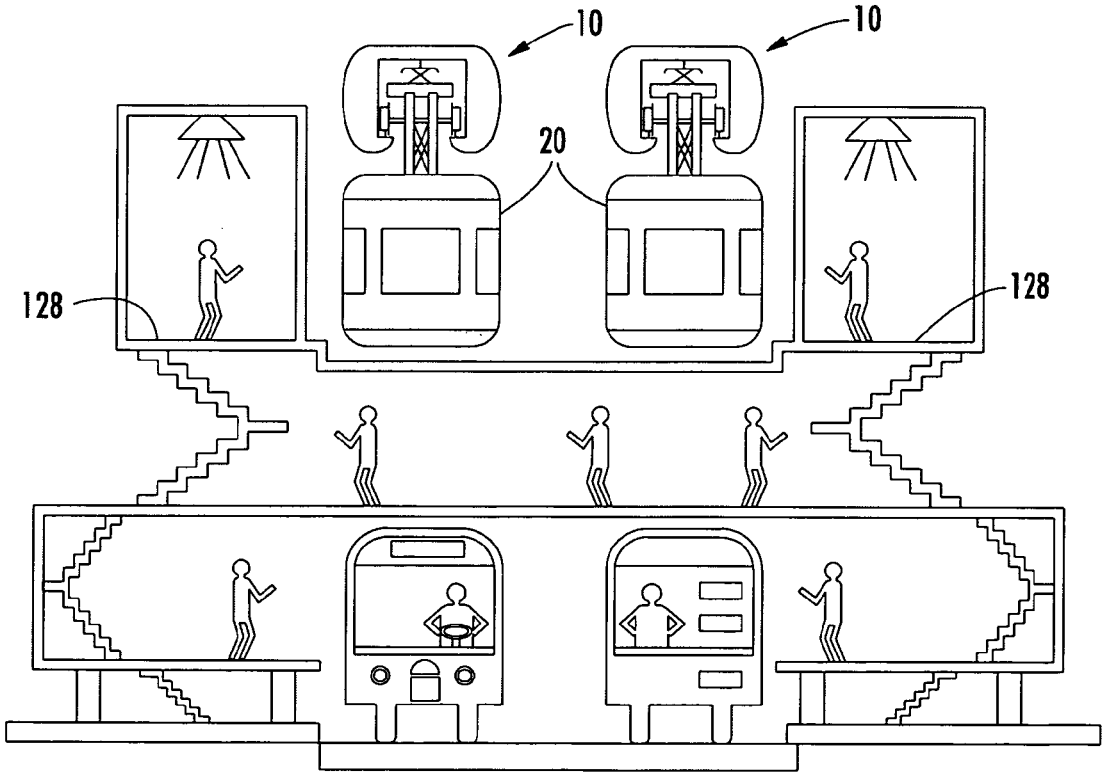
FIG. 22 is a pictorial view illustrating an embodiment of a station useful with embodiments of the present invention.

As illustrated with reference again to FIG. 1 and to FIGS. 21 and 22, station platforms 128 may be installed at a level to match the level of the floors 130 in the car body 20. There is only the thickness of the floor beneath the car, so the roof of any waiting areas below or underpass may be only a short distance beneath the platform, of the order of 10 feet by way of example. Waiting rooms or pedestrian underpasses need be only far enough down to permit persons to walk freely below, a height of some 8' as an example. Platforms are shown having edge doors that enclose the space on the platform, so the enclosed the waiting area can be air conditioned for passenger comfort. This ability to pass beneath the car body at relatively close elevations allows space at intermediate level above the roadway where a pedestrian underpass could afford passage for public access connecting both sides of the alignment. Rapid and convenient handling of containers 132, such as airfreight styled containers by way of example, results. By way of further example, and with reference again to FIG. 21, a "rollodeck" styled floor 134 may be installed in one or various portions of the car body for ease in moving the container 132 from the station platform 128 onto the car body floor 130. The rollodeck floor 134 on the station platform may be covered by a normal walking floor that can be removed to expose the rollodeck floor when needed. Yet further, added features, such as a safety net 135 are easily accommodated, as illustrated by way of example with reference again to FIG. 1.

With reference again to FIG. 2, by way of example, power supply may provide electrical power through contact strips 136 carried on walls or ceiling of the duct 24 for supplying electric power to the carrying vehicles 72. The vehicles 72 may be self-propelled, as in diesel-electric units that would use an on-board electric power supply. Similar contact strips 136 may be used for other purposes, such as command and communication. The carrying vehicle 72 may or may not have motors and control systems for propulsion. As earlier described, the wheels of the trucks or bogies may be steel wheels according to railroad or light rail tradition, or may be rubber tires, or any form of "Maglev" or other means of affording movement for the vehicle trucks, according to the nature of the roadway surface in the duct. It is a new feature that multiple carrying vehicles can be coupled together in the duct, with or without bodies suspended underneath, to form trains of any length according to the needs of the service.

By way of example regarding safety, the slot 26 is too narrow to allow the carrying vehicle 72 to fall through. Consequently, safety is assured because the carrying vehicle 72 is locked into the duct, and the "latch and lock" function of the suspension system prevents accidental detach of the suspended bodies.

Contact strips in the duct or on the "I" beams may supply electric power and command and communication to the vehicles. Also these contact strips may be used for other purposes as needed. Independent carrying vehicles can be coupled together into long trains, with or without detachable car bodies suspended beneath them.

The carrying vehicles in the duct cannot fall through the slot, while in the beam design mechanical protrusions over the track area would keep the vehicles from falling and so are safely restrained against falling to the ground.

Figure 6A:
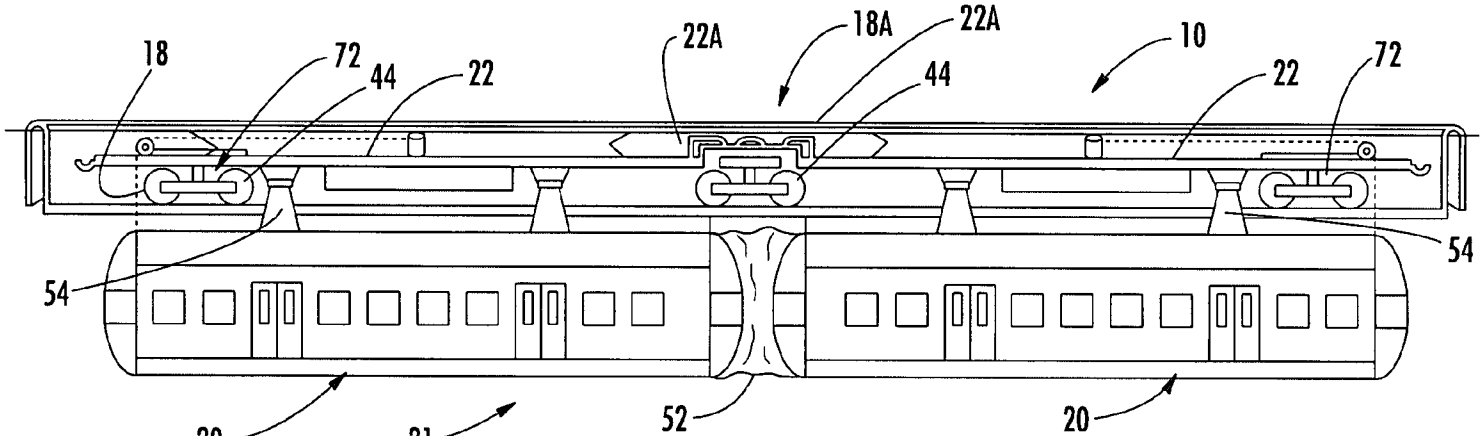

By way of further example, embodiments of the present invention may include the carrying vehicle 72 or chassis 22 in the duct 24 using either the truck 18 or bogie at each end of the chassis with two trucks per carrying vehicle or use a single truck 18A carrying the end 22A of adjacent chassis in an arrangement defined as "articulation" as illustrated with reference to FIG. 6A. This articulation allows two carrying vehicles 72 to share the articulating truck 18A, resulting in a reduction in the total number of wheels 44 required to carry the train 21.

Super-elevation of the track has no relationship to comfort within the car body 20 at standstill on a curve, although this is the controlling factor in bottom-supported vehicles. The permissible angle of super-elevation of the track in the system 10 depends solely upon the coefficient of friction restraining the wheels of the trucks from sliding sideways on the super-elevated track. By way of example, the swinging out of the car body 20 by 10° or more plus the greater super-elevation by 10° or more of the track 46 in the duct 24 on curves allows curving speeds significantly faster than bottom-supported systems allowing the centrifugal force to reach or exceed 0.34 G.

Pipes may be attached on the side or top of the duct to be able to pump liquids through to spray on fires below or to fertilize plants, trees or crops below. The car body may include a tank car with pumps may be suspended to spray on areas below. The pumps may be powered from the contact line in the duct, or the car may carry engines and pumps independent of the power supply lines.

By way of example, the system 10 may be applied to long haul passenger or freight services, at speeds faster than on bottom-supported rail lines. Cars can be small or large to suit the demands of the service. Immediate applications may be in metropolitan areas where there is desperate need for additional transit capacity that cannot be furnished at ground level without absorbing existing roadway capacity, or where tunneling underground is uneconomic and not necessary. There is equally a need in intercity transportation where modern land uses make it inordinately expensive and commercially disruptive, clearing obstructions to create new rights of way on the ground. Embodiments of the present invention including the system 10 herein described by way of example, will render all levels of rail service from 4, 5 or 6 single cars per hour up to full subway levels of trains of ten cars or more every two minutes. A local Preference Poll of potential riders in Pinellas County Florida has shown that monorails are preferred over elevated light rail by 40% and over elevated bus ways by 140%.

The system lends itself to transporting freight in the same way. Freight bodies or combination bodies can be exchanged and suspended beneath any chassis above. This could be especially useful to transfer containers across city lands from shipside to container yards for sorting and loading on to long-haul freight trains. The duct or "I" beam can carry electricity, tracks and signaling for the operation, and for extra revenue, pipelines, communication systems and accessory power for street lighting. Separation of the return electrical system from the ground into the elevated duct avoids the corrosion effect that electric rail trolley systems on the ground have on buried metal plumbing etc.

While the system herein described by way of example provides embodiments with performance characteristics superior to modern bottom supported rail or tired vehicles, mainline railroads and transit systems and while overhead suspension eliminates risk of grade crossing accidents at all speeds, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the appended claims.

That which is claimed is:

1. A transportation system comprising:

a running surface;

a support structure for positioning the running surface above ground level;

a carrying vehicle operable along the running surface;

a rigid suspension member rotatably connected to the carrying vehicle;

a car body rigidly attached to the suspension member, wherein a single axis of rotation of the car body is above a connection of the suspension member to the carrying vehicle, thus effectively extending a radius of rotation of the car body, the car body having a floor surface for carrying a load thereon, wherein the floor surface moves from a horizontal orientation to a tilted orientation during operation of the carrying vehicle along a curved portion of the running surface so as to result in a pendulum like movement of the floor surface and thus the load, wherein the rigid suspension member includes a first support at a proximal end thereof carried by the carrying vehicle and a linking arm connected between the car body and the first support, wherein the linking arm includes an arcuate member rotatably operable with a surface of the first support and a bracket having a proximal end operable with the arcuate member and a distal end affixed to the car body.

2. A system according to claim 1, wherein the carrying vehicle comprises:

a truck;

wheels operable with the truck for rolling along the running surface; and a chassis carried by the truck, wherein the car body is suspended therefrom.

3. A system according to claim 1, wherein the suspension member is pivotally connected to the carrying vehicle, and wherein the car body is allowed to freely rotate about a longitudinal axis thereof while having a restricted movement in a longitudinal direction.

4. A system according to claim 1, further comprising at least one of a generally U-shaped duct having a slot therein formed by opposing flanged portions, an I-beam having opposing lower flanged portions, and an I-beam pair having opposing outer flange portions, upper surfaces of which form the running surface.

5. A system according to claim 1, further comprising a rail pair forming a track carried by the running surface, wherein the carrying vehicle is operable thereon.

6. A system according to claim 5, wherein at least a portion of the track is superelevated by at least eight degrees, and wherein the superelevated track includes one rail of the rail pair at a different elevation than the opposing rail.

7. A system according to claim 1, wherein at least a portion of the running surface is superelevated, and wherein the superelevated running surface includes one side of the surface at a different elevation than an opposing transverse side thereof.

8. A system according to claim 7, wherein the superelevated portion of running surface is inclined by at least eight degrees.

9. A system according to claim 7, wherein the at least a portion of the running surface includes curved portions thereof.

10. A transportation system comprising:

a running surface including a steel rail pair forming a track;

a support structure for positioning the running surface above ground level;

a truck having steel wheel pairs operable along the running surface with the wheel pairs synchronized and tapered for self centering while rolling along the track;

a chassis carried by the truck;

a car body suspended from the chassis, wherein a center of rotation of the car body is above the connection therebetween, the car body having a floor surface for carrying a load thereon, wherein the floor surface moves from a horizontal orientation to a tilted orientation during operation of the truck along a curved portion of the running surface so as to result in a pendulum like movement of the floor surface and thus the load; and a suspension member for removably suspending the car body from the chassis, the suspension member having a first support at a proximal end thereof carried by the chassis and a linking arm connected between the car body and the first support, wherein the linking arm includes an arcuate member rotatably operable with a surface of the first support and a bracket having a proximal end operable with the arcuate member and a distal end affixed to the car body.

11. A system according to claim 10, further comprising a generally U-shaped duct having a slot therein formed by opposing flanged portions, an upper surface of which forms the running surface.

12. A system according to claim 10, further comprising at least one of an I-beam having opposing lower flanged portions and an I-beam pair having opposing outer flange portions, upper surfaces of which form the running surface.

13. A system according to claim 10, wherein at least two chassis are connected to form a train, and wherein the at least two chassis are connected to a single truck for articulating movement therewith.

14. A system according to claim 10, wherein the support structure comprises a column and cooperating arm portion for supporting the running surface above the ground level.

15. A system according to claim 10, wherein the truck comprises a frame having wheels operable therewith for transporting the truck along the running surface.

16. A system according to claim 10, wherein the track is superelevated at least along a curved portion thereof and wherein the superelevated track includes one rail at a different elevation than an opposing rail.

17. A system according to claim 10, wherein at least a portion of the running surface is superelevated, and wherein the superelevated running surface includes one side of the surface at a different elevation than an opposing transverse side thereof.

18. A system according to claim 17, wherein the superelevated portion of the running surface is inclined by at least eight degrees.

19. A system according to claim 10, wherein the chassis is carried by at least two trucks.

20. A system according to claim 10, wherein the car body comprises at least one of a passenger car, a freight car, and a combination thereof.

21. A system according to claim 20, wherein a plurality of car bodies is suspended from a plurality of chassis, wherein one chassis is connected to an adjacent chassis, and wherein adjacent car bodies are accessible therebetween.

22. A system according to claim 10, further comprising a connector operable with the suspension member for operably attaching and detaching the car body from the chassis, the connector having a vise for receiving the suspension member proximal end therein and a turnbuckle for securing the vise in a locking position.

23. A system according to claim 10, further comprising:

a first bracket pair affixed to the car body; and a second bracket pair affixed to the first support, wherein the linking arm comprises a linking arm pair, each linking arm of the linking arm pair having proximal and distal ends slidably connected to first and second brackets of the first and second bracket pairs for providing a lateral rotation of the car body about the center of rotation located above the chassis, and wherein the center of rotation is laterally displaced during rotation of the car body.

24. A system according to claim 10, wherein the surface of the first support comprises a concave shape for receiving the arcuate member.

25. A system according to claim 10, wherein the arcuate member is circular in cross section.

26. A system according to claim 10, further comprising a winch and cable mechanism carried by the chassis and operable for raising and lowering the car body therefrom.

27. A system according to claim 10, further comprising a grapple operably connected to the chassis, and wherein the car body comprises a container for carrying freight therein.

28. A system according to claim 27, wherein the grapple comprises:

an upper member removably suspended from the chassis; and opposing side members slidably connected to the upper member for cradling the container therebetween.

29. A system according to claim 10, further comprising a driving means operable with the truck for driving the truck along the running surface, wherein wheels operable therewith rotate at a synchronized speed.

30. A system according to claim 29, wherein the driving means comprises an electric motor operable with power delivered thereto from a contact strip carried with the running surface.

31. A transportation system comprising:

a running surface including a steel rail pair forming a track;

a support structure for positioning the running surface above ground level;

a truck having steel wheel pairs operable along the running surface with the wheel pairs synchronized and tapered for self centering while rolling along the track;

a chassis carried by the truck;

a car body suspended from the chassis, wherein a center of rotation of the car body is above the connection therebetween, the car body having a floor surface for carrying a load thereon, wherein the floor surface moves from a horizontal orientation to a tilted orientation during operation of the truck along a curved portion of the running surface so as to result in a pendulum like movement of the floor surface and thus the load; and a suspension member removably suspending the car body from the chassis, the suspension member having a proximal end operable with the chassis and an opposing distal end connected to the car body, wherein the suspension member includes a first support carried by the chassis and a linking arm connected between the car body and the first support, wherein the linking arm comprises at least one of a spring, a piston, and a combination thereof.

32. A transportation system comprising:

a running surface suspended above ground level;

a carrying vehicle having wheels operable over the running surface;

a rigid suspension member for removably suspending a car body from the carrying vehicle, the suspension member having a proximal end operable with the carrying vehicle and an opposing distal end for connecting to the car body; and a car body rigidly attached to the suspension member, wherein a single axis of rotation of the car body is above a connection of the suspension member to the carrying vehicle, the car body having a floor surface for carrying a load thereon, wherein the floor surface moves from a horizontal orientation to a tilted orientation during operation of the carrying vehicle along a curved portion of the running surface so as to result in a pendulum like movement of the floor surface and thus the load, wherein the rigid suspension member includes a first support at a proximal end thereof carried by the carrying vehicle and a linking arm connected between the car body and the first support, wherein the linking arm includes an arcuate member rotatably operable with a surface of the first support and a bracket having a proximal end operable with the arcuate member and a distal end affixed to the car body.

33. A system according to claim 32, further comprising:

a first bracket pair affixed to the car body; and a second bracket pair affixed to the first support, wherein the linking arm comprises a linking arm pair, each linking arm of the linking arm pair having proximal and distal ends slidably connected to first and second brackets of the first and second bracket pairs for providing a lateral rotation of the car body about the center of rotation located above the carrying vehicle, wherein the center of rotation is laterally displaced during rotation of the car body.

34. A system according to claim 32, wherein the surface of the first support comprises a concave shape for receiving the arcuate member.

35. A system according to claim 32, wherein the arcuate member is circular in cross section.

36. A system according to claim 32, wherein the linking arm comprises at least one of a spring, a piston, and a combination thereof.

37. A transportation system comprising:

a running surface having a rail pair forming a track carried thereby;

a support structure for positioning the running surface above ground level;

a truck operable along the running surface, the truck having wheel pairs synchronized and tapered for self centering while rolling along the track;

a chassis carried by the truck;

a car body suspended from the chassis; and a suspension member having a first support at a proximal end thereof carried by the chassis and a linking arm connected between the car body and the first support, wherein the linking arm includes an arcuate member rotatably operable with a surface of the first support and a bracket having a proximal end operable with the arcuate member and a distal end affixed to the car body.

38. A system according to claim 37 wherein the rail pair and wheel pairs are steel.

39. A system according to claim 37, wherein the track is superelevated at least along a curved portion thereof, and wherein the superelevated track includes one rail at a different elevation than an opposing rail.

40. A system according to claim 39, wherein the superelevated portion of the running surface is inclined by at least eight degrees.

41. A system according to claim 39, wherein the superelevation is within 16 degrees and a swing out of the car body to within 16 degrees beneath the chassis, thus permitting a combined total swing out of up to 32 degrees of tilt for permitting increased car body speeds on curves.

42. A system according to claim 37, wherein the wheel pairs include coned wheels.

43. A system according to claim 37, wherein at least one of the wheel pairs comprises electrically coupled motor wheels.

44. A system according to claim 43, wherein the electrically coupled motor wheels include double flanged wheels.

45. A transportation system comprising:

a running surface having a rail pair forming a track carried thereby;

a support structure for positioning the running surface above ground level;

a carrying vehicle operable along the running surface, the carrying vehicle having wheel pairs with each wheel tapered, the wheel pairs synchronized for self centering while rolling along the track;

a car body suspended from the carrying vehicle; and a suspension member having a first support at a proximal end thereof carried by the carrying vehicle and a linking arm connected between the car body and the first support, wherein the linking arm includes an arcuate member rotatably operable with a surface of the first support and a bracket having a proximal end operable with the arcuate member and a distal end affixed to the car body.

46. A system according to claim 45, wherein a center of rotation of the car body is above a connection to the carrying vehicle thus effectively extending a radius of rotation thereof, the car body having a floor surface for carrying a load thereon, wherein the floor surface moves from a horizontal orientation to a tilted orientation during operation of the carrying vehicle along a curved portion of the running surface so as to result in a pendulum like movement of the floor surface and thus the load.

47. A system according to claim 45, wherein the track and wheel pairs are steel.

48. A system according to claim 45, wherein the track is superelevated at least along a curved portion thereof, and wherein the superelevated track includes one rail surface at a different elevation than an opposing rail surface.

49. A system according to claim 48, wherein the superelevated portion of the running surface is inclined by at least eight degrees.

50. A transportation system comprising:

a running surface suspended above ground level;

a carrying vehicle having wheels operable over the running surface;

a car body;

a suspension member suspending the car body from the carrying vehicle, the suspension member having a proximal end operable with the carrying vehicle and an opposing distal end connected to the car body, the suspension member having a first support carried by the carrying vehicle, a linking arm connected between the car body and the first support, an arcuate member rotatably operable with a surface of the first support, and a bracket having a proximal end rotatably operable with the arcuate member and a distal end affixed to the car body.

51. A system according to claim 50, further comprising:

a first bracket pair affixed to the car body; and a second bracket pair affixed to the first support, wherein the linking arm comprises a linking arm pair, each linking arm of the linking arm pair having proximal and distal ends slidably connected to first and second brackets of the first and second bracket pairs for providing a lateral rotation of the car body about the center of rotation located above the carrying vehicle, wherein the center of rotation is laterally displaced during rotation of the car body.

52. A system according to claim 50, wherein the surface of the first support comprises a concave shape for receiving the arcuate member.

53. A system according to claim 50, wherein the arcuate member is circular in cross section.

54. A system according to claim 50, wherein the linking arm comprises at least one of a spring, a piston, and a combination thereof.

55. A transportation system comprising:

a running surface suspended above ground level;

a carrying vehicle having wheels operable over the running surface; and a car body suspended below the carrying vehicle, wherein a center of rotation of the car body is thereabove;

a suspension member for removably suspending the car body from the carrying vehicle, the suspension member having a proximal end operable with the carrying vehicle and an opposing distal end connected to the car body, wherein the suspension member includes a first support carried by the carrying vehicle and a linking arm connected between the car body and the first support, and wherein the linking arm includes at least one of a spring, a piston, and a combination thereof.

56. A system according to claim 55, further comprising:

a first bracket pair affixed to the car body; and a second bracket pair affixed to the first support, wherein the linking arm comprises a linking arm pair, each linking arm of the linking arm pair having proximal and distal ends slidably connected to first and second brackets of the first and second bracket pairs for providing a lateral rotation of the car body about the center of rotation located above the carrying vehicle, wherein the center of rotation is laterally displaced during rotation of the car body.

57. A system according to claim 55, further comprising:

an arcuate member rotatably operable with a surface of the first support;

a bracket having a proximal end rotatably operable with the arcuate member and a distal end affixed to the car body.

58. A system according to claim 55, wherein the surface of the first support comprises a concave shape for receiving the arcuate member.

59. A system according to claim 55, wherein the arcuate member is circular in cross section.

60. A transportation system comprising:

a running surface having a rail pair forming a track carried thereby, wherein the track is superelevated at least along a curved portion thereof.

a support structure for positioning the running surface above ground level;

a carrying vehicle operable along the running surface; and a car body suspended from the carrying vehicle, wherein a center of rotation of the car body is above a connection to the carrying vehicle, thus effectively extending a radius of rotation thereof, the car body having a floor surface for carrying a load thereon, wherein the floor surface moves from a horizontal orientation to a tilted orientation during operation of the carrying vehicle along the curved portion of the running surface so as to result in a pendulum like movement of the floor surface and thus the load.

61. A system according to claim 60, wherein the track and wheel pairs are steel.

62. A system according to claim 60, wherein the superelevated portion of the running surface is inclined by at least eight degrees.

63. A system according to claim 60, wherein the wheel pairs are synchronized for self centering while rolling along the track.

* * * * *